US011719060B2

(12) United States Patent
Szpunar et al.

(10) Patent No.: US 11,719,060 B2
(45) Date of Patent: Aug. 8, 2023

(54) HYDRAULIC PROTECTION SYSTEM AND METHOD

(71) Applicant: Expro North Sea Limited, Dyce (GB)

(72) Inventors: Dariusz Krzysztof Szpunar, Westhill (GB); Kris Manett, Fraserburgh (GB); Andre Nicolaas Duplessis, Aberdeen (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 17/640,664

(22) PCT Filed: Sep. 1, 2020

(86) PCT No.: PCT/GB2020/052091
§ 371 (c)(1),
(2) Date: Mar. 4, 2022

(87) PCT Pub. No.: WO2021/044133
PCT Pub. Date: Mar. 11, 2021

(65) Prior Publication Data

US 2022/0333451 A1 Oct. 20, 2022

(30) Foreign Application Priority Data

Sep. 4, 2019 (GB) ..... 1912684

(51) Int. Cl.
*E21B 21/10* (2006.01)
*E21B 21/00* (2006.01)

(52) U.S. Cl.
CPC ..... *E21B 21/106* (2013.01); *E21B 21/001* (2013.01)

(58) Field of Classification Search
CPC ..... E21B 21/106; E21B 21/001
See application file for complete search history.

(56) References Cited

U.S. PATENT DOCUMENTS 4,059,148 A * 11/1977 Blomsma ..... E21B 7/128 166/359
4,719,937 A * 1/1988 Roche ..... E21B 21/08 137/526
5,826,658 A * 10/1998 Harthorn ..... E21B 21/106 251/145
9,605,499 B1 * 3/2017 Sun ..... E21B 21/08
2006/0231265 A1 10/2006 Martin
2013/0286546 A1 10/2013 Hazel
2013/0333894 A1 * 12/2013 Geiger ..... E21B 34/04 166/336

* cited by examiner

*Primary Examiner* — James G Sayre
(74) *Attorney, Agent, or Firm* — Getz Balich LLC

(57) ABSTRACT

A hydraulic protection system for preventing collapse of a hydraulic line is provided. The system includes a pressure sensing assembly which is arranged to monitor a pressure differential between fluid external to and fluid contained within the hydraulic line; a pressure compensation assembly adapted to be coupled to the hydraulic line. In the event of a loss of pressure in the hydraulic line occurring, the pressure compensation assembly employs the pressure of the fluid external to the hydraulic line to increase the pressure of the fluid contained within the hydraulic line. The system is arranged so that the pressure compensation assembly is operated when the pressure differential monitored by the pressure sensing assembly reaches a predetermined level, which is below a collapse pressure of the hydraulic line, so that exposure of the hydraulic line to the collapse pressure is avoided.

20 Claims, 12 Drawing Sheets

PROTECTION SYSTEM WITH PILOT ACTIVATION AT PRESSURE $P_{ACT} > P_{MR}$

HYDRAULIC PROTECTION SYSTEM AND METHOD

This application claims priority to PCT Patent Appln. No. PCT/GB2020/052091 filed Sep. 1, 2020, which claims priority GB Patent Appln. No. 1912684.6 filed Sep. 4, 2019, which are herein incorporated by reference.

BACKGROUND OF THE INVENTION

1. Technical Field

The present invention relates to a hydraulic protection system for preventing collapse of a hydraulic line in the event of a loss of pressure occurring, and an associated method. In particular, but not exclusively, the present invention relates to an umbilical protection system for preventing collapse of an umbilical line of a subsea umbilical located within a marine riser, in the event of a loss of pressure occurring in the umbilical line.

2. Background Information

In the oil and gas exploration and production industry, it is often necessary to provide hydraulic power to one or more components or tools, for controlling their operation. Hydraulic power is provided via hydraulic control lines extending from a surface facility (e.g. a drilling rig) to the components/tools, the hydraulic lines containing a clean hydraulic fluid, which is typically oil, water, or a water/glycol based fluid.

Where a well is located in an offshore environment, a wellhead of the well is positioned at seabed level, with pressure control equipment including a blow-out preventer (BOP) located on the wellhead or Christmas Tree. A string of tubing known as a marine riser extends from the surface facility to the seabed, where it is connected to the BOP. During completion of the well in preparation for production, and during subsequent procedures including a workover or intervention procedure, the marine riser usually houses a smaller diameter string of tubing known as a landing string, which is connected to the BOP. The landing string provides a pathway through which tools, tubing and fluid can pass between the surface facility and the well. The landing string typically comprises hydraulically actuated components which are operated from the surface.

In this scenario, hydraulic lines for operating the components are typically provided within an umbilical assembly. The hydraulic lines are bundled together with other lines or cables such as electrical power/communication lines, and are encased within an outer umbilical jacket or sleeve. The umbilical assembly is located with the marine riser, extending along an annulus which surrounds the landing string.

During completion of the well in preparation for production, and in other relevant scenarios, the marine riser annulus is filled with a 'clean' fluid known as brine, which is a water-based solution of certain salts. The umbilical assembly is disposed within the annulus and so exposed to the brine, which penetrates the outer umbilical jacket. Brine is typically more dense ('heavier') than the hydraulic fluid contained within the hydraulic lines. This has the result that, for a given water depth, the hydrostatic pressure of the brine will be greater than the hydrostatic pressure of the hydraulic fluid within the control lines. Consequently, the hydraulic control lines experience an external pressure differential, between the fluid which is external to the lines, and the fluid contained within the lines.

Hydraulic lines can be in a pressurised or vented state. In a vented state, the pressure in a hydraulic line equals the hydrostatic head of hydraulic control fluid (at a given depth). Similarly, pressure around the umbilical (the marine riser pressure) amounts to the hydrostatic head of the marine riser fluid. If marine riser pressure is higher than the pressure in the umbilical (internal pressure), due for example to the marine riser fluid being heavier than the control fluid, then a differential pressure acts on the hydraulic line which seeks to collapse it. This is called the 'collapse pressure' acting on the hydraulic line.

One of the parameters which describe umbilical lines is their collapse pressure rating. This is a measure of the maximum differential pressure (from external to internal) which an umbilical line can withstand. In an in-riser application, this usually refers to a scenario in which it is still safe to operate the umbilical with umbilical hydraulic lines in a vented state.

Typically, umbilical lines are selected and used such that the maximum external pressure differential expected on a particular project is smaller than the umbilical line's collapse pressure rating. This is relatively easy to achieve in shallow water jobs, using standard umbilicals having a small collapse pressure rating. However, with greater depths, heavier marine riser fluids or both, the collapse pressure, which may exist when hydraulic lines are in a vented state, may be in excess of the collapse pressure rating of most umbilicals currently available on the market. Umbilicals having lines with a sufficiently high collapse pressure rating could be built, but would be very heavy, expensive and difficult to handle, making their use prohibitive.

This problem has conventionally been addressed by pressuring all of the umbilical lines during operations, protecting them from collapse, typically using a hydraulic power unit (HPU) at the surface. The internal pressure within the umbilical lines is then the hydrostatic pressure of the hydraulic control fluid (at a given depth), plus the pressure applied to the control fluid by a pump of the HPU. Umbilical lines are designed so that they can support high internal pressures, typically having a reinforcing mesh which counteracts tension in a wall of the umbilical due to the internal pressure. A burst pressure of an umbilical line is therefore relatively high, and is often significantly higher than its collapse pressure. The umbilical lines are therefore capable of supporting the pressure applied by the HPU without bursting.

Problems can occur in the event that there is an HPU leak at the surface or in other related surface equipment, an inadvertent pressure vent from the umbilical lines, or a very low pressure in a wellbore. Affected lines will then vent, which may result in the lines collapsing, at a depth where collapse pressure exceeds the umbilical line's rated collapse pressure.

One way in which this problem has been addressed has involved the use of back pressure regulators in the HPU, which protect the umbilical lines by keeping a minimum (regulated) pressure in the return circuit. However, back pressure regulators only protect umbilical lines during a system vent; they are not able to protect the umbilical lines in the case of a leak at surface.

It will be understood that the problems outlined above are not restricted to umbilical lines of a subsea umbilical, and can be experienced in hydraulic lines used in other environments/industries, and in other applications in the oil and gas exploration and production industry. In general terms, these problems can be experienced in any situation where a hydraulic line experiences an external pressure differential in which a pressure of fluid external to the line is greater than a pressure of fluid within the line.

SUMMARY OF THE INVENTION

According to a first aspect of the present invention, there is provided a hydraulic protection system for preventing collapse of a hydraulic line in the event of a loss of pressure occurring, the system comprising: a pressure sensing assembly which is arranged, in use, to monitor a pressure differential between fluid external to the hydraulic line and fluid contained within the hydraulic line; and a pressure compensation assembly which is adapted to be coupled to the hydraulic line and which is exposed, in use, to the fluid external to the hydraulic line; in which, in the event of a loss of pressure in the hydraulic line occurring, the pressure compensation assembly is operable to employ the pressure of the fluid external to the hydraulic line to increase the pressure of the fluid contained within the hydraulic line and thereby compensate for the loss; and in which the system is arranged so that the pressure compensation assembly is operated when the pressure differential monitored by the pressure sensing assembly reaches a predetermined level, which is below a collapse pressure of the hydraulic line, so that exposure of the hydraulic line to the collapse pressure is avoided and collapse of the line prevented.

The present invention may address problems in the prior art, particularly in the context of umbilical lines of an umbilical disposed in a marine riser. The system is effectively arranged so that the pressure compensation assembly is automatically operated when the pressure differential monitored by the pressure sensing assembly reaches the predetermined level. This increases the pressure of the fluid contained within the hydraulic line, raising the pressure and so preventing the collapse pressure being breached, and therefore a consequent collapse of the hydraulic line.

The system may be an umbilical protection system for protecting an umbilical line of a subsea umbilical located within a marine riser from collapsing in the event of a loss of pressure occurring in the umbilical line. The hydraulic line may therefore be an umbilical line of an umbilical. It will be understood however that the hydraulic line may be for location within a marine riser, but not necessarily provided within or as part of an umbilical. In the particular context of an umbilical line, a pressure loss may occur in the case of a leak at surface (where the line is pressurised), inadvertent pressure vent, or a very low (unexpected) pressure occurring in the umbilical line. The system may be adapted to be disposed within the marine riser, and may be connectable to the umbilical for location within the marine riser. Optionally, the system is adapted to be disposed at, proximate, or towards an end of the umbilical, which may be an end which is deepest/furthest from a surface facility, and which may be proximate a BOP, Christmas Tree and/or wellhead.

Reference is made to a pressure differential between fluid external to the hydraulic line and fluid contained within the hydraulic line. In normal use, the fluid in the hydraulic line may be pressurised to a level which is above a pressure of the fluid external to the line. The hydraulic line may therefore normally experience a negative pressure differential (external relative to internal), and may be capable of supporting such a pressure differential without exceeding a burst pressure and rupturing, due to the construction of the line (e.g. including reinforcement). In the event of a loss of pressure within the hydraulic line occurring, the pressure of the fluid within the hydraulic line may approach the hydrostatic pressure of the internal fluid. This will have the result that the pressure differential increases. If the hydrostatic pressure of the external fluid is greater than the hydrostatic pressure of the fluid in the hydraulic line, this runs the risk of the line experiencing a positive pressure differential, which pressure differential may be greater than the collapse pressure of the line. The invention seeks to address this by employing the pressure of the fluid external to the hydraulic line to increase the pressure of the fluid contained within the line.

The pressure sensing assembly may be arranged to trigger or operate the pressure compensation assembly when the differential pressure reaches the predetermined level. The sensing assembly may be arranged to operate the compensation assembly when the pressure differential is negative. Operation may therefore occur when the pressure of the fluid in the hydraulic line is still above that of the external fluid. The sensing assembly may be arranged to operate the compensation assembly when the pressure differential is zero or approximately zero. Operation may therefore occur when the pressure of the fluid in the hydraulic line is equal or approximately equal to that of the external fluid. The sensing assembly may be arranged to operate the compensation assembly when the pressure differential is positive (but still below the collapse pressure). Operation may therefore occur when the pressure of the fluid in the hydraulic line is below that of the external fluid.

The pressure sensing assembly may be exposed to fluid in the hydraulic line. The sensing assembly may be exposed to fluid external to the hydraulic line. The sensing assembly may be operable to compare the pressure in the hydraulic line with the external pressure, and to operate the pressure compensation assembly when the differential pressure between the external fluid pressure and the pressure of the fluid in the hydraulic line reaches the predetermined level.

The pressure compensation assembly may be arranged to communicate the pressure of the external fluid to the fluid contained within the hydraulic line. Fluid communication between the external fluid and the fluid within the line may be restricted. In other words, the pressure compensation assembly may be capable of transmitting the pressure of the external fluid to the fluid in the line, without actual flow/transfer of external fluid into the line occurring.

The pressure compensation assembly may be arranged to permit fluid communication between the external fluid and the fluid in the hydraulic line, so that external fluid flows in to the hydraulic line.

The pressure sensing assembly may be moveable between an activated state and a deactivated state. In the activated state, the sensing assembly may maintain the pressure compensation assembly in a deactivated state, in which it is isolated from the umbilical line. In the deactivated state of the sensing assembly, the compensation assembly may be operated to move to an activated state in which it increases the pressure of the fluid in the hydraulic line. In the activated state the compensation assembly may be fluidly connected to, or in fluid communication with, the hydraulic line.

The pressure compensation assembly may be arranged so that, in a main operation or activated state, it can communicate the pressure of the external fluid to the fluid within the hydraulic line. This may avoid fluid communication between the external fluid and the fluid in the hydraulic line. The pressure compensation assembly may be arranged so that, in a further operation or activated state, it permits fluid communication between the external fluid and the fluid in the hydraulic line. Accordingly, in the further operation state, external fluid may flow into the hydraulic line. When the pressure compensation assembly is initially moved to the main operation state, in which it is in fluid communication with the hydraulic line, the hydraulic fluid to which it is exposed may be at a higher pressure than the external fluid. This will depend upon factors including an operation or trigger point of the pressure sensing assembly. It will be understood that continued loss of pressure in the hydraulic line will cause a drop in the pressure that the compensation assembly is exposed to, which is compensated for by communication of the pressure of the external fluid to the fluid in the line.

The pressure compensation assembly may be arranged so that it only moves to the further operation state in a situation in which communication of the external pressure to the fluid in the hydraulic line has failed to reduce the pressure differential to a safe/desired level, which may be below the predetermined level. Such may occur, for example, in the event of a continued leak of hydraulic fluid from the hydraulic line occurring.

The pressure compensation assembly may be coupled to the hydraulic line by a fluid conduit. The fluid conduit may contain a hydraulic fluid, which may be the same as that contained within the hydraulic line. This may provide a 'clean' hydraulic fluid barrier between external fluid and the hydraulic fluid in the line.

The pressure compensation assembly may communicate the external fluid pressure to the fluid in the conduit. In the main operation state of the compensation assembly, the conduit may be out of fluid communication with the external fluid. In the further operation state of the compensation assembly, the conduit may be in fluid communication with the external fluid.

In a variation, the pressure compensation assembly may comprise a conduit which is in permanent fluid communication with the external fluid. The pressure sensing assembly may serve for selectively opening fluid communication between the hydraulic line and the conduit in order to transmit external fluid into the line.

The pressure compensation assembly may comprise at least one valve, which may be coupled to the conduit, and which may be capable of permitting fluid communication between the external fluid and the conduit. The valve may be biased towards a closed position. In the closed position, fluid communication between the external fluid and the fluid in the line (flow of external fluid into the line) may be prevented. Such fluid communication may be through the valve and into the conduit. Movement of the valve to an open position may occur in the event of pressure loss in the hydraulic line, a pressure differential across the valve then acting to move the valve against a biasing force to its open position. The compensation assembly may comprise a filter associated with the at least one valve, and which may serve for filtering external fluid flowing in to the valve. The filter may act to remove contaminants, such as solid particles, contained within the external fluid. The at least one valve may be a one-way valve, which may prevent flow of hydraulic fluid from the line to the exterior of the line. The compensation assembly may comprise a bypass line, for bypassing the filter in the event that it becomes blocked or clogged, the bypass line optionally comprising a bypass valve which is arranged to open at a higher pressure than the at least one valve that permits fluid communication between the external fluid and the conduit.

The pressure sensing assembly may comprise a valve assembly which is moveable between: a closed position (activated state) in which the pressure compensation assembly is isolated from the hydraulic line; and an open position (deactivated state) in which the pressure compensation assembly is in communication with the hydraulic line. The valve assembly may be arranged to move from the closed position to the open position in the event that the pressure differential reaches the predetermined level. In the open position, the pressure of the fluid external to the hydraulic line may be communicated to the fluid in the hydraulic line. In the open position, fluid communication between the external fluid and the fluid in the hydraulic line may be permitted, so that external fluid flows into the hydraulic line.

The valve assembly may comprise a valve having a first valve face which is exposed to the fluid in the hydraulic line, and a second (opposed) valve face which is exposed to the external fluid. During normal operation, where the hydraulic line is pressurised and no loss of pressure occurs, the fluid inside the hydraulic line may be at a higher pressure than the external fluid (and may be at a significantly higher pressure, applied for example at surface by an HPU). This may act to maintain the valve in its closed position, for example by urging a valve element of the valve into a closed position. The valve assembly may comprise a pilot line which is coupled to the hydraulic line, through which pilot pressure of the fluid in the hydraulic line is communicated to the valve assembly, in particular the valve element. In the event of a loss of pressure in the hydraulic line occurring, a pressure differential may exist between the second valve face and the first valve face, which may urge the valve to the open position. This may move the valve element to an open position. The valve may be biased towards the open position, for example by a biasing element such as a spring. This may serve to move the valve to the open position. The valve may move to the open position by a combination of a force of the spring and the external fluid pressure. The valve may be a directional control valve (DCV), and may be a shuttle valve.

The pressure compensation assembly may comprise a pressure compensator. The pressure compensator may be exposed to the fluid external to the hydraulic line. The pressure compensator may be in communication with, or in selective communication with, the fluid in the hydraulic line. The pressure compensator may serve for communicating the pressure of the external fluid to the fluid in the hydraulic line. The pressure compensator may define a pressure transmission member, which may define a barrier between the external fluid and the fluid in the hydraulic line, to prevent external fluid flow into the hydraulic line. The pressure transmission member may be moveable under the applied pressure of the external fluid, to communicate the external pressure to the fluid in the hydraulic line. The pressure transmission member may be a piston that is movable within a cylinder, or a membrane/diaphragm which is movable within a chamber, the cylinder/chamber being in selective communication with the hydraulic line (in particular via the conduit).

The pressure compensation assembly may comprise a pressure booster or pressure intensifier, which may be exposed to the external fluid, and which may be arranged to direct external fluid into the hydraulic line. The pressure booster may act to raise a pressure of the external fluid that is directed into the hydraulic line to a level which is above that of the pressure of the fluid external to the line. This may provide a boost to the pressure of the fluid, providing an enhanced compensation effect for the loss of pressure in the hydraulic line. The pressure booster may be or may comprise a pump.

The pressure compensation assembly may comprise both the pressure compensator and the pressure booster/intensifier. The pressure compensator and the pressure booster may be arranged to be actuated simultaneously, or sequentially. In the latter case, one of the pressure compensator and the pressure booster may be arranged to be actuated prior to the other one of the pressure compensator and the pressure booster. The pressure compensation assembly may be arranged so that said other one of the pressure compensator and the pressure booster is only actuated in the event that actuation of the first of said components fails to increase the pressure of the fluid in the hydraulic line to a desired level. The pressure compensator and the pressure booster may be arranged in parallel.

The pressure compensation assembly may comprise both the pressure compensator and the at least one valve; optionally the pressure booster/intensifier and the at least one valve; and optionally the pressure compensator, the pressure booster/intensifier and the at least one valve. The pressure compensator and the at least one valve, and/or the pressure booster/intensifier and the at least one valve, may be arranged so that the pressure compensator/booster is operated prior to said valve being opened. In this way, contamination of the hydraulic fluid in the hydraulic line with external fluid may be avoided, or at least initially avoided. In the event that loss of pressure continues, the at least one valve may be operated, to direct external fluid into the hydraulic line. Operation of the at least one valve may be automatic, when the pressure differential across the valve drops to a level which is sufficient for the valve to open. This may occur in the event of continued pressure loss, which may occur once a capacity of the pressure compensator (e.g. a storage capacity of the cylinder/chamber) has been exhausted, and/or in the event that the pressure booster fails to increase the pressure of the fluid in the hydraulic line to a desired level.

The system may be for preventing collapse of a plurality of hydraulic lines, and may comprise a plurality of pressure sensing assemblies. Optionally, one or more pressure sensing assembly may be provided for each hydraulic line. The pressure compensation assembly may be associated with a plurality of the pressure sensing assemblies. Optionally, a single pressure compensation assembly is provided and is associated with all of the pressure sensing assemblies of the system. It will be understood however that the system may comprise a plurality of pressure compensation assemblies, which may provide a degree of redundancy, or which may be better suited where there are a relatively large number of hydraulic lines. The pressure compensation assembly may be arranged so that it is triggered into operation when a pressure differential measured by any one of the pressure sensing assemblies (associated with the compensation assembly) reaches the predetermined level. It will be understood that this may be indicative that the hydraulic line associated with that pressure sensing assembly has suffered a pressure loss. It will further be understood that multiple pressure loss scenarios, in multiple hydraulic lines, can be accommodated.

The predetermined level of the pressure differential may vary from one hydraulic system to another, and may be dependent upon a number of factors, including but not restricted to: a collapse pressure rating of the hydraulic line; a density (weight) of the external fluid; a density (weight) of the fluid in the hydraulic line; an expected hydrostatic pressure of the external fluid (e.g. for a particular water depth); and/or an expected hydrostatic pressure of the fluid in the hydraulic line (e.g. for a particular water depth).

The predetermined level may be a negative pressure differential level, in which the pressure of the fluid contained within the hydraulic line remains higher than the pressure of the external fluid. This may ensure against hydraulic line collapse by triggering the hydraulic protection system when a leak has occurred, but at a time when the internal hydraulic line pressure is still higher than the external fluid pressure.

The predetermined level may be at or around zero pressure differential. Triggering may therefore occur when the pressure of fluid contained within the hydraulic line is the same as (or approximately the same as) the external fluid pressure.

The predetermined level may be a positive pressure differential. Triggering may therefore occur when the pressure of fluid contained within the hydraulic line is less than the external fluid pressure, but at a time when the differential is less than the collapse pressure.

Factors impacting on the predetermined level (and so triggering of the system) may include depth within a well; hydrostatic pressure; the collapse rating of the hydraulic line; the density of the hydraulic fluid; and the density of the external fluid.

According to a second aspect of the present invention, there is provided a hydraulic line comprising the hydraulic protection system of the first aspect of the invention.

According to a third aspect of the present invention, there is provided a subsea umbilical comprising at least one hydraulic line, and the hydraulic protection system of the first aspect of the invention.

According to a fourth aspect of the present invention, there is provided a subsea riser comprising a subsea umbilical having at least one hydraulic line, and the hydraulic protection system of the first aspect of the invention.

According to a fifth aspect of the present invention, there is provided a riserless system comprising a subsea umbilical having at least one hydraulic line, and the hydraulic protection system of the first aspect of the invention.

Further features of the hydraulic protection system forming part of the hydraulic line, subsea umbilical, and subsea riser of the second to fifth aspects of the invention may be derived from the text set out elsewhere in this document, in particular in or with reference to the first aspect of the invention.

According to a sixth aspect of the present invention, there is provided a method of preventing collapse of a hydraulic line in the event of a loss of pressure in the hydraulic line occurring, the method comprising the steps of: monitoring a pressure differential between the fluid external to the hydraulic line and the fluid contained within the hydraulic line; coupling a pressure compensation assembly to the hydraulic line; exposing the pressure compensation assembly to the fluid external to the hydraulic line; and in the event of a loss of pressure in the hydraulic line occurring, which loss of pressure leads to an increase in the pressure differential, causing the pressure compensation assembly to employ the pressure of the fluid external to the hydraulic line to increase the pressure of the fluid contained within the hydraulic line and thereby compensate for the loss; in which the method comprises operating the pressure compensation assembly when the pressure differential monitored by the pressure sensing assembly reaches a predetermined level, which is below a collapse pressure of the hydraulic line, so that exposure of the hydraulic line to the collapse pressure is avoided and collapse of the line prevented.

The method may comprise monitoring the pressure differential using a pressure sensing assembly. The pressure sensing assembly and pressure compensation assembly may form a hydraulic protection system, which may be the system of the first aspect of the invention.

The method may be a method of protecting an umbilical line of a subsea umbilical located within a marine riser from collapsing in the event of a loss of pressure occurring in the umbilical line. The method may comprise locating the pressure compensation assembly and the pressure sensing assembly within the marine riser. The method may comprise connecting the pressure compensation assembly and the pressure sensing assembly to the umbilical and locating the umbilical within the marine riser.

In the event of a pressure loss, the method may comprise arranging the pressure compensation assembly to communicate the pressure of the external fluid to the fluid contained within the hydraulic line.

In the event of a pressure loss, the method may comprise arranging the pressure compensation assembly to permit fluid communication between the external fluid and the fluid in the hydraulic line, so that external fluid flows into the hydraulic line.

In the event of a pressure loss, the method may comprise arranging the pressure compensation assembly in a main operation or activated state, in which it communicates the pressure of the external fluid to the fluid within the hydraulic line. The method may comprise arranging the pressure compensation assembly in a further operation or activated state, in which it permits fluid communication between the external fluid and the fluid in the hydraulic line. The method may comprise moving the pressure compensation assembly to the further operation state only in a situation in which communication of the external pressure to the fluid in the hydraulic line has failed to reduce the pressure differential to a safe/desired level, which may be below the predetermined level.

The method may comprise providing a pressure compensation assembly having a pressure compensator, and arranging the compensator so that it is exposed to the fluid external to the hydraulic line. In the event of a pressure loss, the method may comprise arranging the pressure compensator so that it is in communication with the fluid in the hydraulic line. The method may comprise operating the pressure compensator to communicate the pressure of the external fluid to the fluid in the hydraulic line.

The method may comprise providing a pressure compensation assembly having a pressure booster or pressure intensifier, and arranging the pressure booster so that it is exposed to the external fluid. In the event of a pressure loss, the method may comprise arranging the pressure booster to direct external fluid into the hydraulic line. The pressure booster may act to raise a pressure of the external fluid that is directed into the hydraulic line to a level which is above that of the pressure of the fluid external to the line.

The method may comprise providing a pressure compensation assembly having both the pressure compensator and the pressure booster/intensifier. The method may comprise operating the pressure compensator and the pressure booster simultaneously, or sequentially. The method may comprise arranging the pressure compensation assembly so that said other one of the pressure compensator and the pressure booster is only actuated in the event that actuation of the first of said components fails to increase the pressure of the fluid in the hydraulic line to a desired level.

The method may comprise providing a pressure compensation assembly having at least one valve, which may be coupled to the hydraulic line via a conduit. In the event of a pressure loss, the method may comprise arranging the valve to open, to permit fluid communication between the external fluid and the conduit. The method may comprise operating the at least one valve automatically, by arranging the valve so that it opens when a pressure differential across the valve drops to a level which is sufficient for the valve to open.

The method may comprise providing a pressure compensation assembly comprising both the pressure compensator and the at least one valve; optionally the pressure booster/intensifier and the at least one valve; and optionally the pressure compensator, the pressure booster/intensifier and the at least one valve. The method may comprise arranging the pressure compensator and/or the pressure booster and the at least one valve so that the pressure compensator and/or the pressure booster is operated prior to said valve being opened. In the event that loss of pressure continues, the method may comprise arranging the at least one valve to be operated, to direct external fluid into the hydraulic line.

The method may be a method of preventing collapse of a plurality of hydraulic lines, and may comprise monitoring a pressure differential between the fluid external to the hydraulic lines and the fluid contained within all of the hydraulic lines, optionally employing a plurality of pressure sensing assemblies. The method may comprise providing one or more pressure sensing assembly for each hydraulic line. The method may comprise arranging the pressure compensation assembly so that it is associated with a plurality of the pressure sensing assemblies. Optionally, the method comprises arranging a single pressure compensation assembly so that it is associated with all of the pressure sensing assemblies. The method may comprise arranging the pressure compensation assembly so that it is triggered into operation when a pressure differential between the external fluid and the pressure of the fluid in any one of the lines reaches the predetermined level.

Further features of the method of the sixth aspect of the invention may be derived from the text set out elsewhere in this document, in particular in or with reference to the first aspect of the invention.

BRIEF DESCRIPTION OF THE DRAWINGS

Embodiments of the present invention will now be described, by way of example only, with reference to the accompanying drawings, in which.

DETAILED DESCRIPTION OF THE INVENTION

The hydraulic protection system and method of preventing collapse of a hydraulic line of the present invention has a particular use in the oil and gas exploration and production industry, specifically as an umbilical protection system for preventing collapse of an umbilical line of a subsea umbilical located within a marine riser, in the event of a loss of pressure occurring in the umbilical line. The invention will be described in relation to such a system and method. It will be understood, however, that the principles of the invention may be applied to other subsea systems including riserless systems (such as riserless intervention systems). A riserless system employs a subsea umbilical that is not located in a marine riser, and so which typically extends through open water between a surface facility and a subsea location (such as a Christmas tree or BOP). It will also be understood, however, that the principles of the invention may be applied to hydraulic lines used in other environments/industries, and in other applications within the oil and gas exploration and production industry. In general terms, the problems in the prior art discussed above can be experienced in any situation where a hydraulic line experiences an external pressure differential, in which a pressure of fluid external to the line is greater than a pressure of fluid within the line.

Figure 1:
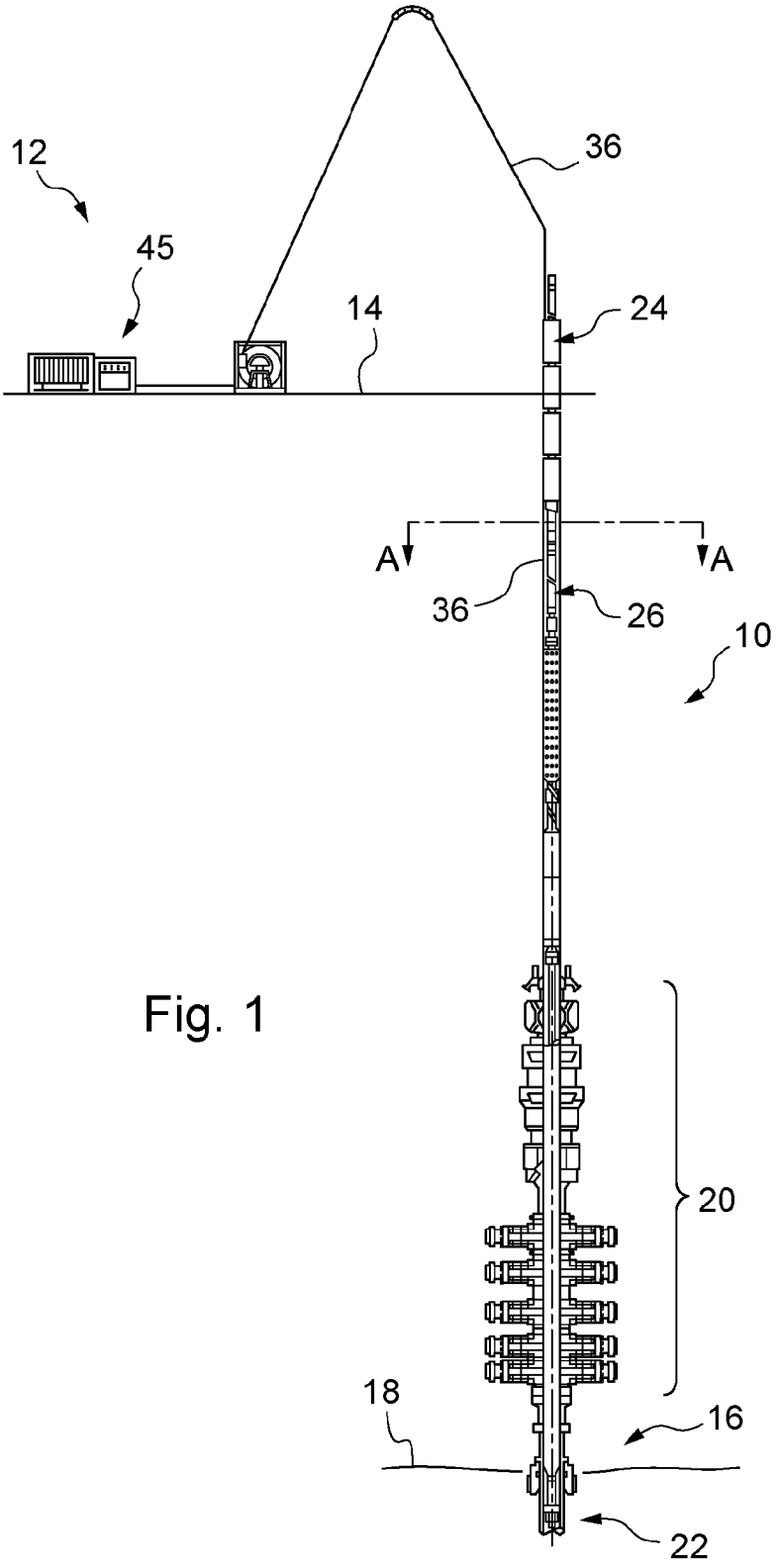
FIG. 1 is a side view of a marine riser which has been deployed from a surface facility, in the form of a drilling rig located at sea surface in an offshore environment, the marine riser shown deployed from a floor of the rig into the water towards a subsea wellhead located at or near the seabed.

Turning firstly to FIG. 1, there is shown a side view of a marine riser, indicated generally by reference numeral 10, and which has been deployed from a surface facility such as a drilling rig, indicated schematically by numeral 12 in the drawing. The drilling rig 12 is located at sea surface in an offshore environment, and the marine riser 10 has been deployed from a floor 14 of the rig into the water towards a subsea wellhead, the wellhead indicated by reference numeral 16 and located at or near the seabed 18.

In a fashion known in the art, a BOP assembly 20 has been located on the wellhead 16, and provides pressure control during subsequent operations. The procedure illustrated in FIG. 1 may be a step in completing a well 22 for production, or a workover/intervention procedure carried out at a later stage, for example during subsequent production of well fluids. The procedures involved in preparing a well for completion, and workover/intervention procedures, are well known in the art and will not be discussed in further detail here.

As is well known, the marine riser 10 comprises a string of large diameter tubing which is suspended from the rig 12 and connected to the BOP assembly 20. The riser 10 includes a Riser Sealing Module (RSM) indicated by reference numeral 24, which protects a subsea umbilical 36.

The marine riser 10 is shown partially sectioned in the drawing, with a landing string located within the riser, the landing string indicated generally by reference numeral 26. This is better shown in the enlarged cross-sectional view of FIG. 2, taken about the line A-A in FIG. 1, but without showing additional components of the landing string which are located further down the riser, for ease of illustration.

Figure 2:
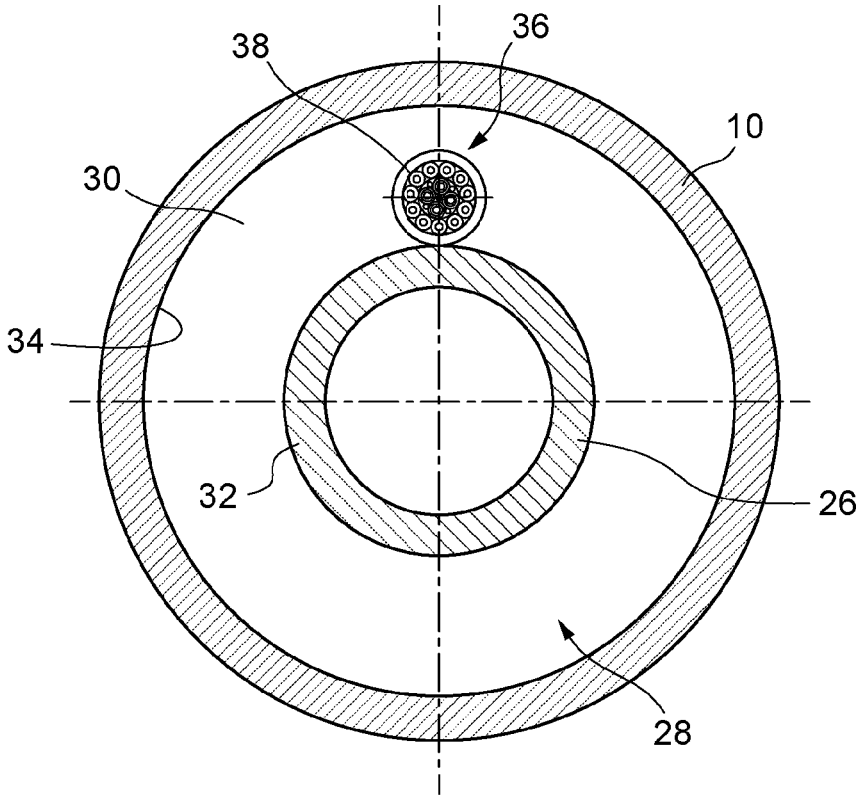
FIG. 2 is an enlarged cross-sectional view of the marine riser, taken about the line A-A in FIG. 1, but without showing additional components of the landing string which are located further down the riser, for ease of illustration.

As can be seen from FIG. 2, the landing string 26 is located generally centrally within a bore 28 of the riser 10, so that an annular space or annulus 30 is defined between an external surface 32 of the landing string 26, and an internal surface 34 of the riser 10. The subsea umbilical 36 is located within the marine riser 10, and provides power and control functions for components located within the marine riser. Such might include the provision of hydraulic power to hydraulically actuated equipment, electrical power to electrically powered equipment, and/or control signals for controlling the operation of equipment, which equipment may be located within the marine riser 10, typically provided as part of the landing string 26. Hydraulically operated components may include valves and packers. It will be understood that a wide range of different equipment may be provided within the marine riser 10 and/or as part of the landing string 26, and whose operation is powered and/or controlled through the umbilical 36.

The umbilical 36 comprises a number of umbilical lines, as best shown in the cross-sectional view of FIG. 2. In the illustrated embodiment, the umbilical includes an umbilical line 38 which takes the form of a hydraulic control line, containing hydraulic control fluid for providing hydraulic power/control functions to equipment forming part of the landing string 26, as described above.

During completion or a workover procedure, the marine riser annulus 30 is filled with brine, or some other relatively "clean" fluid. The umbilical 36 is exposed to the brine, which penetrates an outer jacket or sleeve 40 of the umbilical. As a result, the umbilical line 38 experiences an external pressure which is equivalent to the pressure of the brine in the annulus 30. The hydrostatic pressure of the brine, at a particular depth within the water, will typically be greater than the hydrostatic pressure of the control fluid within the umbilical line 38 at that depth, when the line is in a vented state (in which no pressure is applied from surface at the rig 12). The resulting pressure differential between the brine in the annulus 30, and the control fluid in the umbilical line 38, then exerts a net pressure upon the umbilical line which seeks to collapse it.

Figure 3:
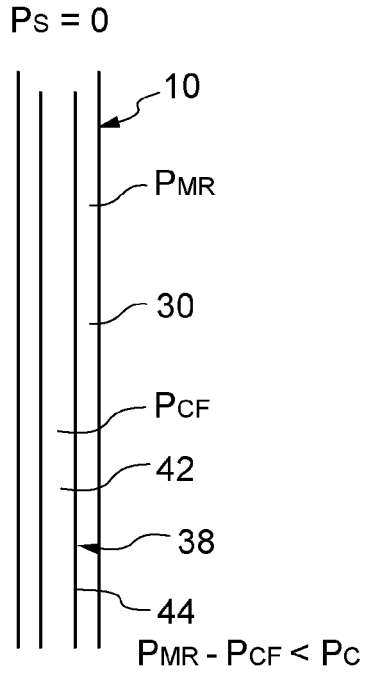
FIG. 3 is a highly schematic enlarged side view of the marine riser, which shows just the riser and an umbilical line in a vented state.

This is indicated in highly schematic form in the enlarged side view of FIG. 3, which shows just the marine riser 10 and the umbilical line 38. In the vented situation, in which no pressure is applied to the hydraulic control fluid in the line 38 at surface, the hydrostatic pressure in the marine riser annulus 30 at a particular water depth ($P_{MR}$), minus the pressure of control fluid in a bore 42 of the umbilical line 38 at that depth ($P_{CF}$), is equal to the external pressure differential acting upon a wall 44 of the umbilical line 38. As long as $P_{MR}-P_{CF}<P_C$ (where $P_C$ is a collapse pressure rating of the umbilical line 38), then the vented umbilical line 38 is safe from collapse. This may be the case in relatively shallow-water environments.

Figure 4:
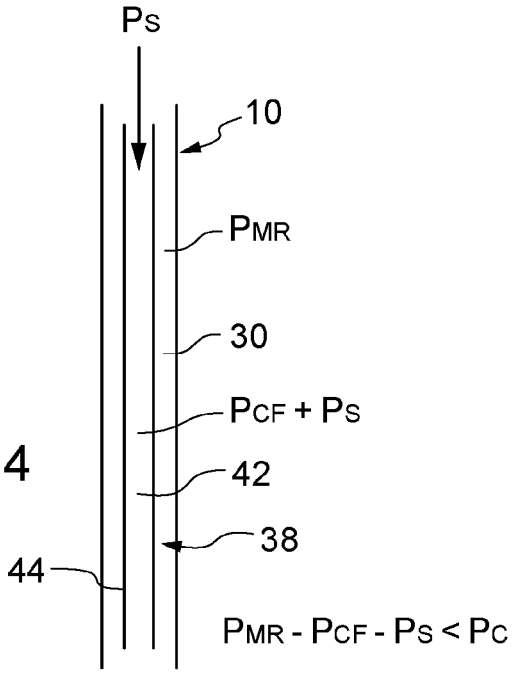
FIG. 4 is view which corresponds to FIG. 3, but showing the umbilical line pressurised from surface.

The risk of the umbilical line 38 collapse pressure rating $P_C$ being breached is exacerbated in deep water environments, where the hydrostatic pressure ($P_{MR}$) of the brine in the riser annulus 30 is significantly greater than the hydrostatic pressure ($P_{CF}$) of the control fluid in the umbilical line 38. Accordingly, and to counteract this, pressure is applied to the control fluid in the umbilical line 38 at surface, via an HPU 45 (FIG. 1), which includes a pump (not shown) for imparting pressure to the control fluid, the pressure applied at surface indicated as $P_S$. This is shown in FIG. 4. This acts to counteract the significant hydrostatic pressure $P_{MR}$ of the brine 30, by raising the pressure of the control fluid within the umbilical line 38. In this scenario, collapse of the umbilical line 38 will be avoided provided that $P_{MR}-P_{CF}-P_S<P_C$.

Figure 5:
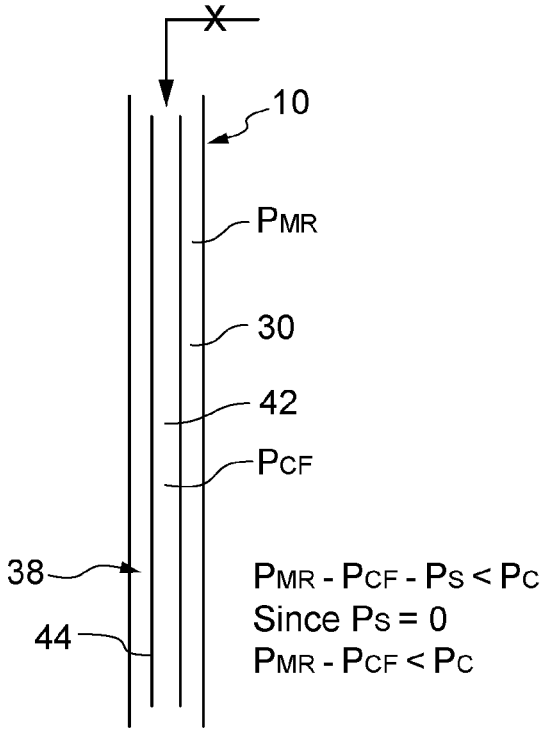
FIG. 5 is a view which corresponds to FIG. 4, but showing a situation in which there has been a reduction in the pressure of control fluid within the umbilical line, for example due to a leak at surface.

FIG. 5 indicates a situation in which there has been a reduction in the pressure of the control fluid within the umbilical line 38, for example due to a leak at surface. This has the consequence that $P_S$ is now zero, and risks the collapse pressure rating $P_C$ of the umbilical line being breached. This is because the differential pressure imparted upon the umbilical line 38 is now simply $P_{MR}-P_{CF}$, which could be greater than the collapse pressure $P_C$ of the umbilical line 38.

The present invention seeks to address this problem by providing a hydraulic protection system for preventing collapse of a hydraulic line, in this case the umbilical line 38, in the event of such a loss of pressure occurring. In the context of the umbilical 36, the hydraulic protection system is an umbilical protection system. The protection system is indicated schematically in the enlarged side view of FIG. 6, which illustrates a normal operating scenario in which the umbilical line 38 is pressurised from surface. As discussed above, collapse of the umbilical line 38 is avoided by the application of sufficient pressure at surface ($P_S$) to counteract the pressure in the marine riser ($P_{MR}$). This is achieved by monitoring the hydrostatic pressure of the brine in the riser annulus 30, typically at a location which is above annular sealing rams of the BOP assembly 20 (which isolate the riser annulus so that the hydrostatic pressure is unaffected by other pressure events/sources), and then determining the pressure $P_S$ which must be applied at surface, using the HPU 45, in order to avoid breaching the collapse pressure rating ($P_C$) of the umbilical line 38. Again therefore a relationship is maintained such that $P_{MR}-P_{CF}-P_S<P_C$.

Typically, a burst pressure rating of the umbilical line 38 will be significantly higher than its collapse pressure rating, the wall 44 of the line being reinforced (e.g. with a reinforcing mesh) to counteract tension in the wall to the internal pressure. Consequently, the pressure $P_S$ which is applied at surface will raise the absolute pressure within the hydraulic line 38 to a level which is well above the external pressure in the marine riser $P_{MR}$.

Figure 6:
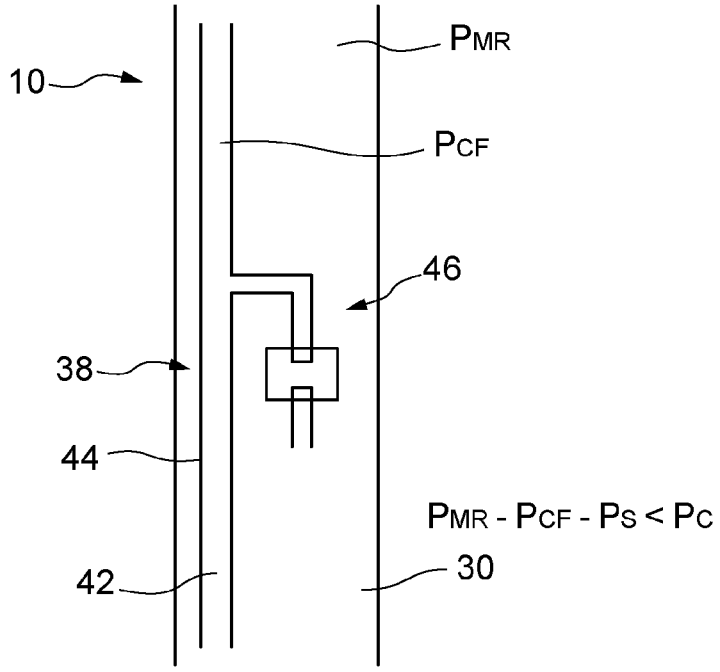
FIG. 6 is a highly schematic enlarged side view of the marine riser which is similar to FIG. 3, showing the umbilical line in a pressurised state, and illustrating a hydraulic protection system in accordance with an embodiment of the present invention.
Figure 7:
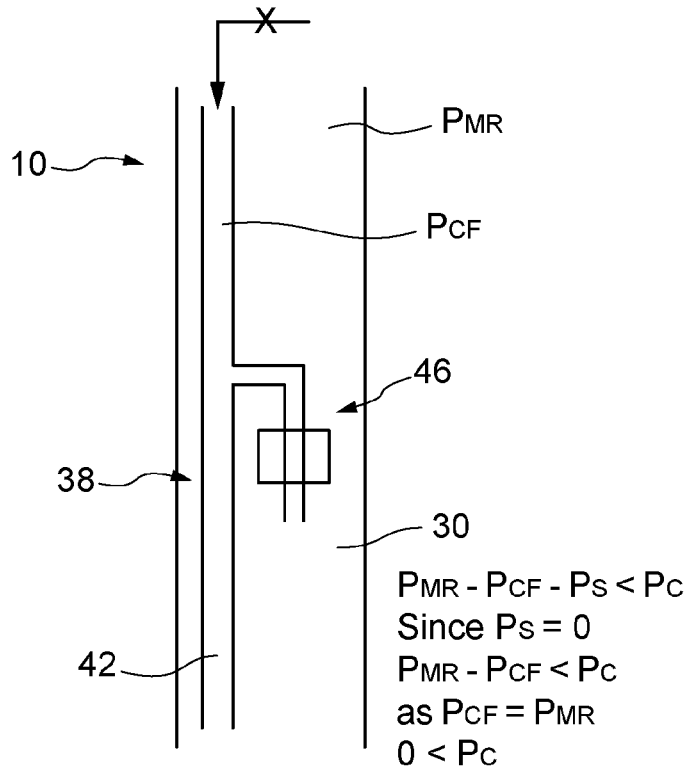
FIG. 7 is a view which corresponds to FIG. 6, but indicates a scenario in which a pressure loss has occurred from the umbilical line, for example due to a leak at surface, and which shows the hydraulic protection system following operation to compensate for loss of pressure in the line.

FIG. 7 corresponds to FIG. 6, but indicates a scenario in which a pressure loss has occurred from the umbilical line 38, for example due to a leak at surface. As described above, this has the result that the pressure applied to the control fluid in the bore 42 of the hydraulic line 38 bleeds away, so that $P_S$ equals zero. This risks the collapse pressure rating $P_C$ of the umbilical line being breached, because the pressure relationship may now be such that $P_{MR}-P_{CF}>P_C$.

This is addressed by the provision of the hydraulic protection system of the present invention, which is indicated generally by reference numeral 46 in the drawings. In the illustrated embodiment, and as discussed above, the hydraulic protection system takes the form of an umbilical protection system for protecting the umbilical line 38 from collapsing in the event of such a loss of pressure occurring in the line.

Figure 8:
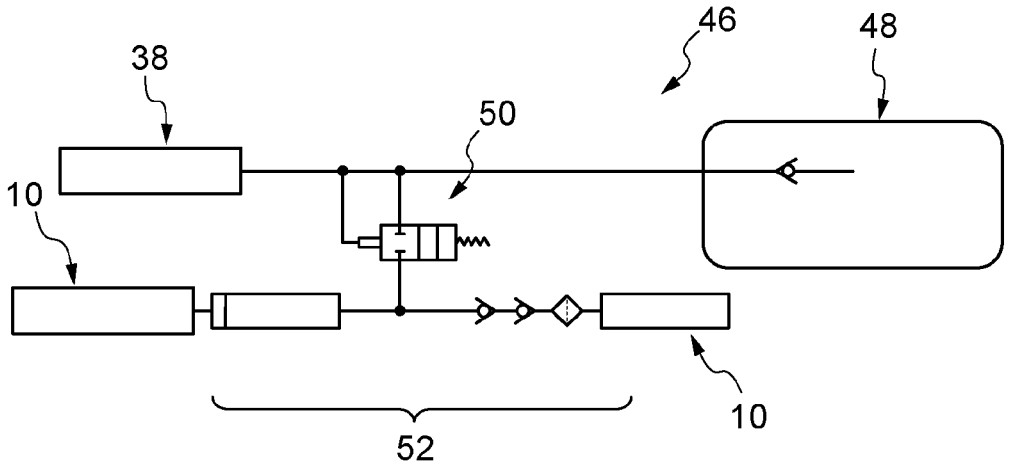
FIG. 8 is a hydraulic circuit diagram showing the umbilical protection system in more detail.

Key components of the umbilical protection system 46 are shown in the schematic hydraulic circuit diagram of FIG. 8. In the drawing, the marine riser 10 and umbilical line 38 are shown in schematic form, as is a hydraulically controlled subsea component, indicated by reference numeral 48. The component 48 may for example be a valve, and operation of the component is controlled by the umbilical line 38.

The protection system 46 comprises a pressure sensing assembly 50 which is arranged to monitor the pressure differential between the fluid external to the hydraulic line 38 (the brine in the riser annulus 30) and the fluid contained within the hydraulic line 38 (the hydraulic control fluid in the bore 42 of the umbilical line). The protection system 46 also comprises a pressure compensation assembly indicated generally by reference numeral 52. The compensation assembly 52 is coupled to the umbilical line 38, and is also exposed to the fluid external to the hydraulic line, which is the brine in the riser annulus 30.

In the event of a loss of pressure in the hydraulic line 38 occurring, which leads to an increase in the external pressure differential acting on the hydraulic line, the pressure compensation assembly 52 is operable to employ the pressure of the fluid external to the hydraulic line (the brine in the annulus 30) to increase the pressure of the fluid contained within the umbilical line 38 (the hydraulic control fluid), and thereby compensate for the loss.

The protection system 46 is arranged so that the compensation assembly 52 is operated when the pressure differential monitored by the pressure sensing assembly 50 reaches a predetermined level, which is below the collapse pressure rating ($P_C$) of the umbilical line 38. In this way, exposure of the umbilical line 38 to the collapse pressure $P_C$ is avoided, and collapse of the line prevented. This is because, following the leak at surface which leads to the pressure applied to the control fluid in the umbilical line 38 bleeding away, $P_S$ is now zero. This risks umbilical line collapse occurring. However, operation of the umbilical protection system 46, in which the pressure compensation assembly 52 employs the pressure of the brine in the riser annulus 30 to increase the pressure of the control fluid in the umbilical line 38, has the result that the pressure in the umbilical line is maintained below the collapse pressure, i.e. $P_{MR}-P_{CF}<P_C$. This is because $P_{CF}$ is now equal to $P_{MR}$, which is less than $P_C$ (since $P_{CF}=P_{MR}$ which is $<P_C$). As $P_{CF}=P_{MR}$, this has the result that the collapse pressure rating is not breached, since $0<P_C$.

Figure 9:
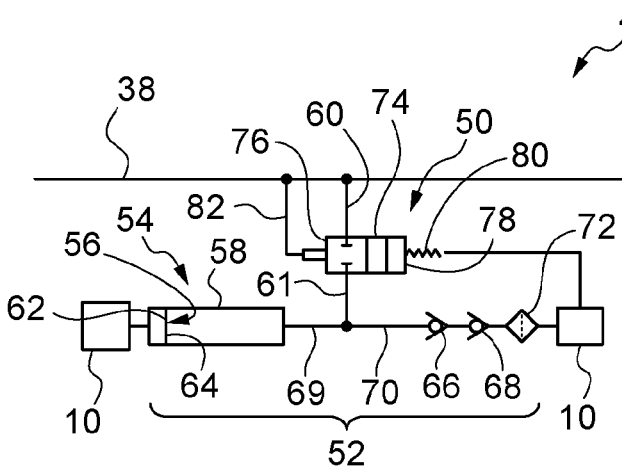
FIGS. 9 and 10 are views of the umbilical protection system which are similar to FIG. 8, showing the system prior to operation (FIG. 9), and following operation, in the event of a leak having occurred in the umbilical line (FIG. 10)
Figure 10:
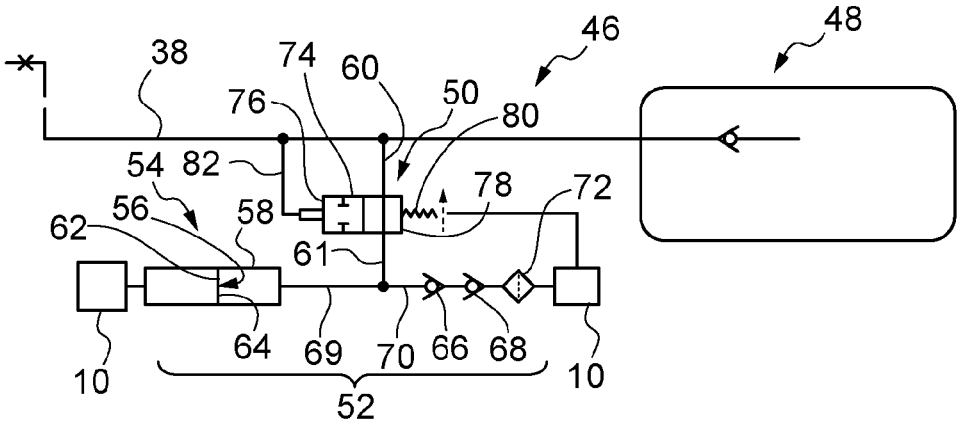

The umbilical protection system 46 will now be described in more detail, with reference also to FIGS. 9 and 10, which show the system prior to operation (FIG. 9), and following operation, in the event of a leak having occurred in the umbilical line 38 (FIG. 10).

In the illustrated embodiment, the pressure sensing assembly is arranged to trigger or operate the pressure compensation assembly 52 when the differential pressure reaches the predetermined level. The sensing assembly 50 is exposed to the control fluid in the hydraulic line 38, which in this case may be a high pressure line containing control fluid at a pressure of, say, around 10 ksi. The sensing assembly 50 is also exposed to the fluid external to the umbilical line 38, which is the brine in the riser annulus 30. As discussed above, the umbilical line 38 is normally pressurised to a level above that of the external fluid via the HPU 45.

The sensing assembly 50 is operable to compare the pressure of the control fluid in the umbilical line 38 with the external pressure of the brine in the riser annulus 30, and to operate the pressure compensation assembly 52 when the differential pressure between the external fluid pressure of the brine, and the internal fluid pressure of the control fluid in the umbilical line 38, reaches the predetermined level. Prior to any leak occurring, there will be a negative pressure differential between the brine in the annulus 30 (the external fluid) and the hydraulic fluid in the line 38 (the internal fluid), since the line is pressurised to above the external pressure level (i.e. the external pressure minus the internal pressure is a negative value).

The pressure sensing assembly 50 is movable between an activated state, which is shown in FIG. 9, and a deactivated state, which is shown in FIG. 10. In the activated state, the sensing assembly 50 maintains the pressure compensation assembly 52 in a deactivated state. The compensation assembly 52 is shown in its deactivated state in FIG. 9, and in its activated state in FIG. 10. The sensing assembly 50 remains in the activated state so long as the pressure differential between the brine and the control fluid remains below the predetermined level, which would be the case unless there is a leak at surface or other event leading to a loss of pressure, as discussed above.

In the event of a loss of pressure occurring, causing the pressure differential to reach the predetermined level, the pressure sensing assembly 50 operates the pressure compensation assembly 52, to move it to an activated state in which the compensation assembly increases the pressure of the fluid in the umbilical line 38.

Figure 10A:
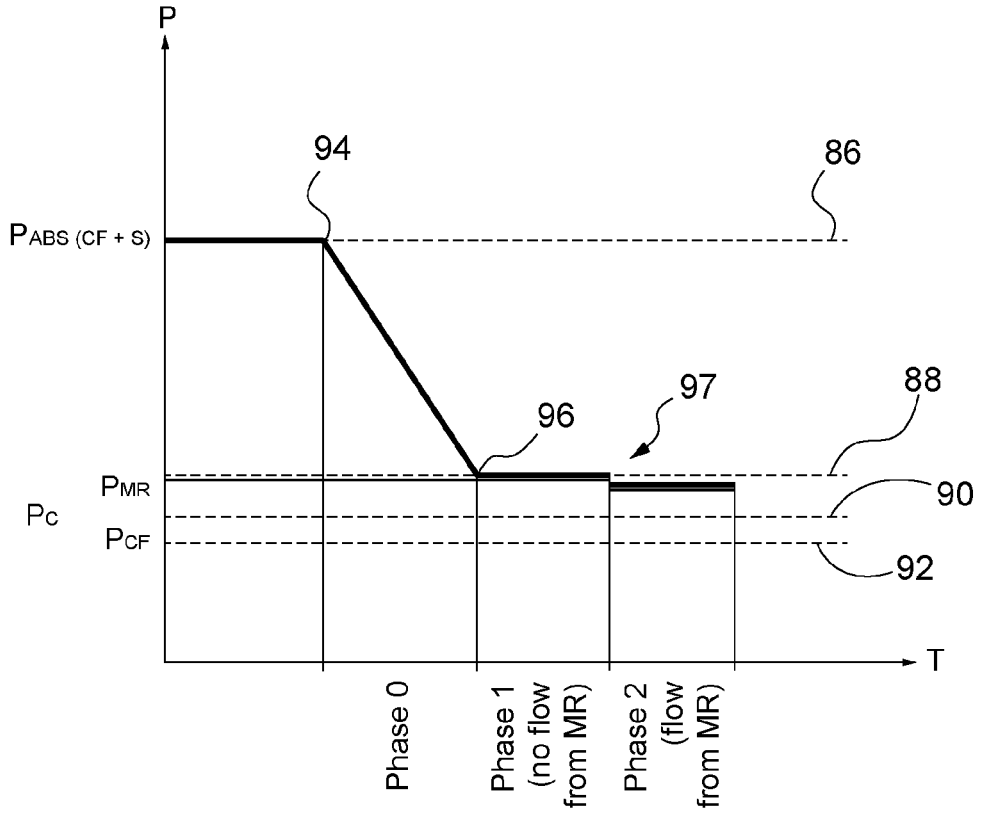
FIGS. 10A and 10B are exemplary graphs of pressure (P) against time (T) both prior to and during operation of the umbilical protection system.

This is illustrated in the graph of pressure (P) against time (T) shown in FIG. 10A. The line 86 in the graph illustrates the absolute pressure Pas in the umbilical line 38. The line 88 illustrates the pressure $P_R$ in the riser annulus 30. The line 90 illustrates the collapse pressure $P_C$ of the umbilical line 38. The line 92 illustrates the hydrostatic pressure $P_{CF}$ of the hydraulic fluid in the line 38.

Prior to a leak occurring, the pressure Pas in the umbilical line 38 is equal to the sum of the hydrostatic pressure $P_{CF}$ of the hydraulic fluid in the line, and the pressure $P_S$ applied by the HPU 45 at surface. The pressure differential between the fluid in the umbilical line 38 ($P_{ABS}$) and the pressure of the brine in the riser annulus 30 ($P_{MR}$) is negative at this time, since $P_{ABS}>P_{MR}$.

In the event of a leak occurring, the absolute pressure $P_{ABS}$ in the umbilical line 38 starts to fall, as indicated at the point 94 in the graph. If the absolute pressure was allowed to fall below the pressure of the fluid in the riser annulus 30 ($P_M$), then this could risk the collapse pressure $P_C$ of the umbilical line 38 being breached (a positive pressure differential between the brine and the hydraulic fluid then existing). The protection system 46, in this example, is arranged so that the pressure sensing assembly 50 triggers the pressure compensation assembly 52 into operation when $P_{ABS}$ and $P_{MR}$ are at or near equilibrium, as indicated at 96 in the graph. This ensures that the umbilical collapse pressure $P_C$ is not breached.

Phase 0 in the graph indicates the period in which the compensation assembly 52 is maintained in its deactivated position by the pressure sensing assembly 50. Phase 1 indicates the period in which the sensing assembly 50 has been deactivated, triggering the compensation assembly 52 to communicate the external brine pressure to the hydraulic fluid in the line 38. Phase 2 indicates the period in which the compensation assembly 52 has been exhausted, and marine riser fluid communicated through the valves 66 and 68 into the umbilical line 38. The pressure step indicated at 97 in the graph is due to the difference between the compensator piston 56 break-out pressure, and the cracking pressure of the non-return valves 66/68.

Figure 10B:
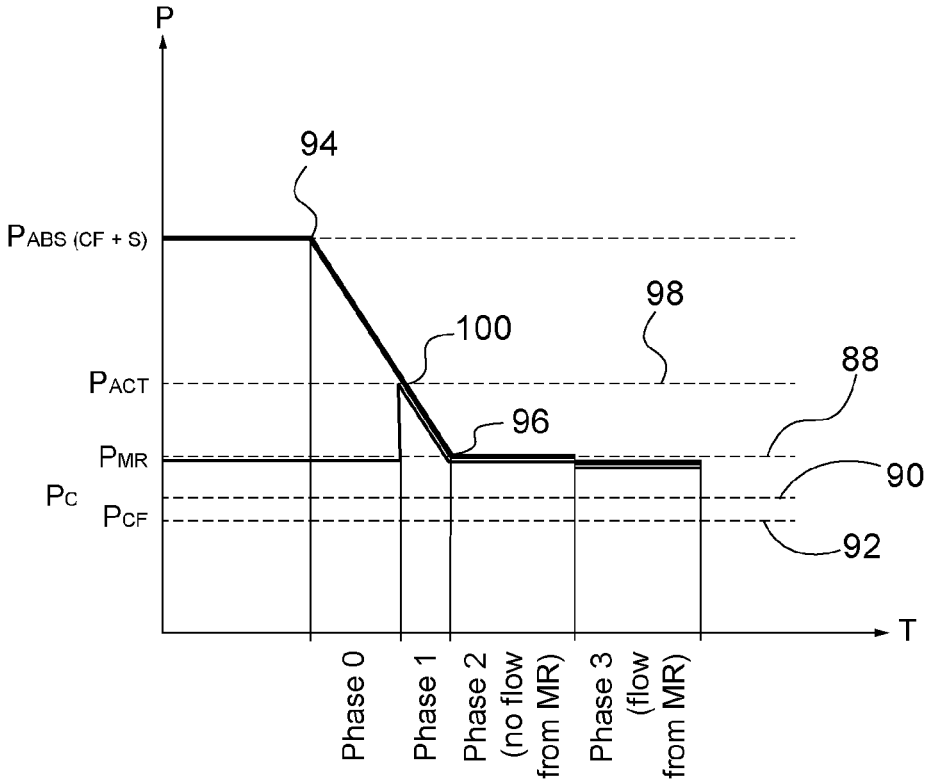

In the example shown in FIG. 10A, triggering has occurred at a time when $P_{ABS}$ and $P_{MR}$ are at or near equilibrium. However, the system may be arranged so that the pressure compensation assembly 52 is triggered into operation when $P_{ABS}$ is at a level which is above $P_{MR}$, in order to ensure against the umbilical collapse pressure $P_C$ being breached. This is illustrated in the alternative graph of FIG. 10B. In this example, triggering occurs at a pressure $P_{ACT}$, which is greater than $P_M$, as indicated by the line 98 in the graph. At this time, a negative pressure differential exists between the brine in the riser annulus 30 and the hydraulic fluid in the line 38. Triggering of the compensation assembly 52 causes the (at that time) higher pressure $P_{ACT}$ of the fluid in the umbilical line 38 to be communicated to the marine riser 10, resulting in the pressure spike in the pressure $P_{MR}$ shown at 100 in the graph. Continued leakage at surface will result in both $P_{ABS}$ and $P_{MR}$ continuing to fall until an equilibrium is reached as indicated at 96 in the graph.

It will be understood that triggering may occur at a pressure which is less than $P_{MR}$, but greater than $P_C$, in the pressure zone which exists between the lines 88 and 90 in the graph. At this time, a positive pressure differential would exist between the brine and the hydraulic fluid.

Figure 10C:
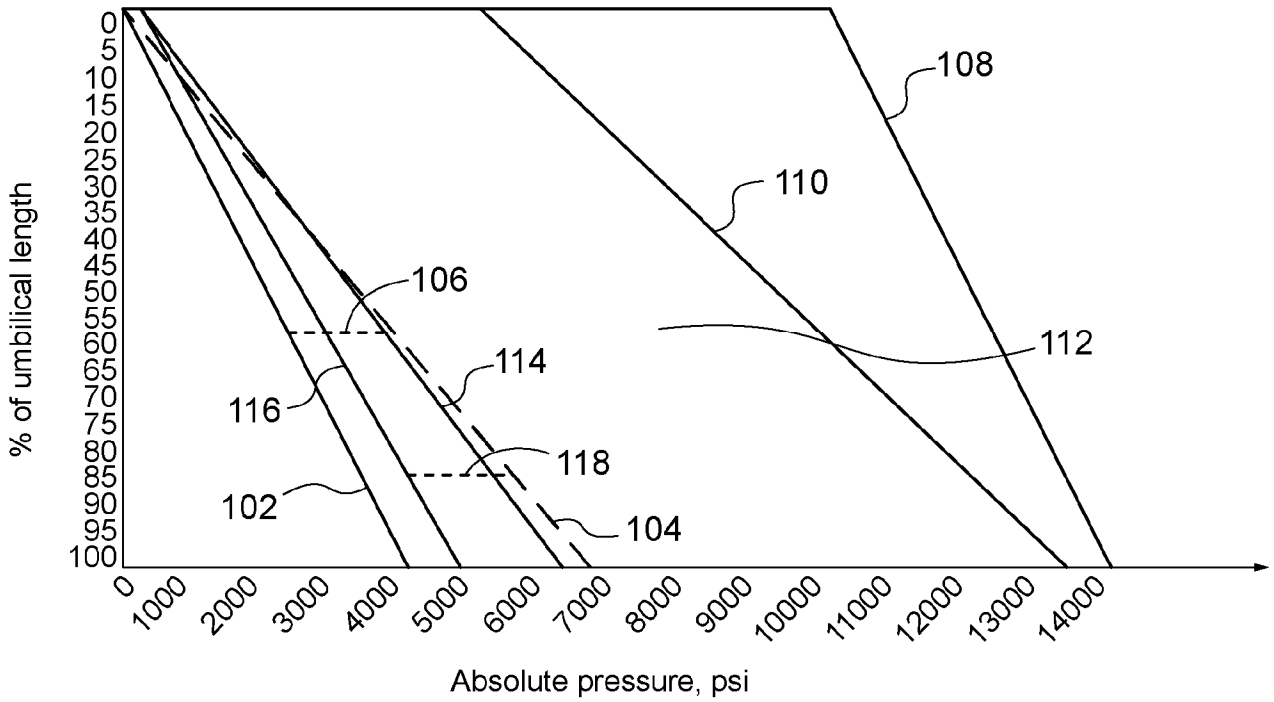
FIG. 10C is a graph illustrating absolute pressure in the umbilical line on the X axis, against the percentage of the length of the umbilical line on the Y axis, without the protection system being operated.

FIG. 10C is a graph illustrating absolute pressure in the umbilical line 38 on the X axis, against the percentage of the length of the umbilical line 38 on the Y axis, without the protection system 46 being operated.

The line 102 shows how the absolute pressure $P_{CF}$ of the hydraulic fluid in the umbilical line 38 changes with depth, from 0 psia at surface to around 4000 psia at the maximum extent of the line (and so the deepest point from surface). The line 104 shows how the absolute pressure $P_{MR}$ in the marine riser varies in comparison to $P_{CF}$. As can be seen from the graph, the difference between these two pressures widens with depth, due to the different densities of the hydraulic fluid in the line 38, and the marine riser fluid (brine). In the absence of pressure applied by the HPU 45 at surface, umbilical collapse would occur as indicated by the line 106, when a positive pressure differential exists which is sufficiently high to breach the collapse pressure rating $P_C$ of the line 38. In this example, $P_C$ is around 1400 psi, and the pressure differential reaches this level at around 55% of the way along the length of the line 38.

The line 108 illustrates the application of pressure at surface using the HPU 45 ($P_{ABS}$). At surface (i.e. zero depth) this pressure $P_{ABS}$ is 10,000 psia as applied by the HPU 45. This increases with depth due to hydrostatic pressure effects, as indicated by the slope on the line, so that at maximum depth the pressure $P_{ABS}$ is 14,000 psia.

The line 110 indicates a situation in which a leak has occurred (as described above), showing the pressure $P_{ABS}$ at a time T1 following commencement of the leak. The subsequent lines 112, 114 and 116 show the pressure $P_{AB}$s at further times T2, T3 and T4 following commencement of the leak, and without the hydraulic protection system of the invention being operated.

As can be seen, the pressure Pas in the umbilical line 38 progressively decreases over time as the leak continues, and results in the umbilical line collapsing at time T4, when the pressure at depth has resulted in a pressure differential sufficient to breach the umbilical collapse pressure $P_C$ (indicated at 118 in the drawing). This pressure differential occurs at around 82.5% of the way along the length of the line 38.

It will be understood that the pressure variations in the line during a leak are dynamic, and that the lines 108 to 116 indicate exemplary pressures along the length of the line (and so with depth from surface) for particular pressures applied at surface. In reality, the dynamic nature of the pressure variations which will occur during a leak will mean that these graphs will not have the straight lines shown, and so should be taken to be illustrative only.

The protection system 46 of the invention enables collapse of the umbilical line 38 to be avoided by raising the pressure in the umbilical line to compensate for the leak, so that the pressure differential does not reach a level at which the line collapse pressure is breached. In the context of FIG. 10C, anywhere to the right of the line 104 illustrating the marine riser pressure $P_{MR}$ may be considered to be a 'safe' activating zone for the system, which is at a time when the pressure $P_{ABS}$ within the line 38 is higher than $P_{MR}$. However and as described above, triggering may occur at or near equilibrium, or at a time when there is a positive pressure differential between the pressure in the line 38 and the external fluid (i.e. to the left of the line 114, but to the right of the line 116).

The pressure compensation assembly 52 has a main operation state in which it communicates the pressure of the brine to the control fluid in the umbilical line 38, in order to compensate for the pressure loss when a leak occurs. This is achieved without actual fluid communication between the brine which is external to the umbilical line 38, and the control fluid within the umbilical line. This avoids any possible contamination of the control fluid by the brine. In a further operation state of the pressure compensation assembly 52, fluid communication between the external brine and the control fluid within the umbilical line 38 is permitted. Accordingly, in the further operation state, the compensation assembly 52 serves for transmitting the pressure of the external brine into the umbilical line 38, to compensate for the pressure loss.

When the pressure compensation assembly 52 is initially moved to the main operation state, in which it is in fluid communication with the umbilical line 38, the hydraulic fluid to which it is exposed may be at a higher pressure than the external brine in the annulus 30. This will depend upon factors including an operation or trigger point of the pressure sensing assembly, as discussed above. If triggering occurs at a time when the absolute pressure $P_{ABS}$ is at a level which is above $P_{MR}$, then the riser pressure $P_{MR}$ within the compensation assembly 52 would step up to the higher level at which actuation occurs ($P_{ACT}$). This would represent Phase 0 in the operation state of the compensation assembly 52. The pressure in the line 38 would, however, continue to fall in the event of a leak occurring. A further phase would therefore exist prior to transmission of the riser pressure through the compensation assembly 52 to the line 38, whilst the pressure bleeds down from the higher level of $P_{ACT}$ towards equilibrium with the riser pressure $P_{MR}$.

The pressure compensation assembly 52 is arranged so that it only moves to the further operation state in a situation in which communication of the external pressure of the brine to the hydraulic control fluid in the umbilical line 38 has failed to reduce the pressure differential to a safe or desired level (which is below the predetermined level). This may occur in the event of a continued leak of hydraulic fluid from the umbilical line 38 occurring.

In order to achieve this, the pressure compensation assembly 52 comprises a pressure compensator 54 which is exposed to the brine in the riser annulus 30, and which is in selective communication with the hydraulic control fluid in the umbilical line 38. The pressure compensator 54 comprises a pressure transmission member in the form of a piston 56, which is movable under the applied pressure of the brine in the annulus 30, to communicate the external pressure to the hydraulic control fluid. The piston 56 is movable within a cylinder 58 in order to transmit the external pressure to the hydraulic control fluid, and provides a barrier between the brine and the control fluid. The compensation assembly 52 comprises an arrangement of fluid conduits 60, 61 and a branch conduit 69 which provide for fluid communication between the compensator 54 and the umbilical line 38. The conduits 60, 61 and 69 also contain a hydraulic fluid, which is typically the same fluid as that provided within the umbilical line 38.

The compensation assembly 52 is charged with the hydraulic fluid at surface, which flows into the compensation cylinder 58, translating the piston 56 to an end of the cylinder and so charging the cylinder with a volume of the control fluid. The piston 56 has opposed first and second piston faces 62 and 64, the first piston face 62 being exposed to the brine in the riser annulus 30, and the second piston face 64 to the hydraulic fluid contained within the cylinder 58.

As will be discussed below, in the event of a leak occurring, fluid communication between the pressure compensator 54 and the umbilical line 38 (via the conduits 69 and 61, valve 74, and the conduit 60) is opened, which means that the hydraulic fluid contained within the cylinder 58 experiences the pressure of the control fluid contained within the umbilical line 38. This pressure acts on the second face 64 of the piston 56. The brine in the riser annulus 30, in contrast, is at the higher external pressure, and this acts on the first piston face 62. The pressure differential between the brine and the hydraulic fluid in the cylinder 58 has the result that a pressure differential force is imparted upon the first piston face 62, urging it to the right in the figure, to pressurise the control fluid in the cylinder 58. This increases the pressure of the control fluid, which is communicated to the control fluid in the umbilical line 38 through the conduit 60, to in-turn raise the pressure of the control fluid in the line and compensate for the pressure loss (Phase 1 in the graph of FIG. 10A). It will be understood that this may involve the flow of hydraulic fluid contained within the conduits 60, 61 and 69 into the umbilical line 38.

In the event that loss of pressure in the umbilical line 38 continues, for example due to continued leakage at surface, the compensator piston 56 will continue to translate within the cylinder 58 towards its far end (to the right in the drawings). When the supply of fluid contained within the cylinder 58 is exhausted, the pressure of the hydraulic fluid in the umbilical line 38 would again continue to drop, increasing the pressure differential between the brine and the hydraulic fluid in the line. In this scenario, the compensation assembly 52 would transition to its further operation state described above.

In order to achieve this, the compensation assembly 52 comprises at least one valve, and in the illustrated embodiment comprises two valves 66 and 68, each of which is coupled to the conduit 61 via a second branch conduit 70. As shown in FIG. 9, the pressure compensator 54 is connected to the conduit 60 via the first branch 69, and the valves 66 and 68 via the second branch 70. The valves 66 and 68 are each exposed to the brine in the riser annulus 30, and biased towards closed positions. The valves 66 and 68 typically take the form of one-way valves such as poppet valves, which are optionally biased by a spring (not shown) towards a closed position in which fluid flow from the riser annulus 30 into the conduit 60 (via the branch 70) is restricted. As the valves 66 and 68 are one-way valves, they automatically prevent fluid flow from the branch 70 into the riser annulus 30, valve elements of the valve being urged into sealing abutment with sealing surfaces of the valves by the pressure of the fluid in the branch 70 (which is normally higher than the external riser pressure), optionally also under the biasing force of the spring.

Figure 9A:
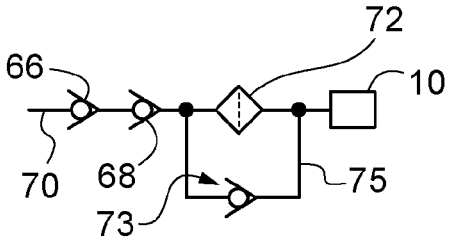
FIG. 9A is an enlarged view of part of the umbilical protection system shown in FIG. 9, illustrating an optional bypass for a filter of the system.

In the event that the pressure compensator 54 becomes exhausted, the pressure of the hydraulic fluid in the umbilical line 38, and so within the conduits 60, 61 and the branches 69 and 70, will start to drop. The pressure differential between the brine in the riser annulus 30 and the hydraulic fluid will then cause the valves 66 and 68 to open, so that brine flows into the conduit 61 through the branch 70. In this way, brine at the higher external pressure of the marine riser 10 will flow through the open valve 74 into the conduit 60, and so on into the bore 42 of the umbilical line 38. This will serve to raise the pressure of the hydraulic fluid in the umbilical line 38, compensating for the pressure loss and so avoiding breach of the collapse pressure rating ($P_C$) of the umbilical line. A filter 72 is provided between the second valve 68 and the marine riser 10, so that brine which is supplied through the valve 68 and into the branch 70 is filtered to remove contaminants such as solids particles. In an option which is shown in the enlarged view of FIG. 9A, a further one-way valve 73 is provided in a line 75 which bypasses the filter 72, which allows riser fluid (brine) to bypass the filter in the event that it becomes clogged. The valve 73 will operate at a higher pressure than the valves 66 and 68, so that it only operates in the event of the filter clogging.

As mentioned above, control of the operation of the pressure compensation assembly 52 is provided by the pressure sensing assembly 50, which will now be described in more detail.

The pressure sensing assembly 50, in the illustrated embodiment, takes the form of a valve assembly comprising a valve 74 having a first valve face 76, which is exposed to the hydraulic fluid in the line 38, and a second opposed valve face 78, which is exposed to the external fluid (brine in the riser annulus 30). Typically, a DCV in the form of a shuttle valve is employed, which is movable between the closed position of FIG. 9 and the open position of FIG. 10.

During normal operation, where the umbilical line 38 is pressurised and no loss of pressure occurs, the fluid inside the umbilical line is at a higher pressure than the pressure of the brine in the riser annulus 30, due to the pressure $P_S$ applied at surface. The valve 74 is biased towards a closed position (FIG. 9) where the conduit 60 is isolated from the compensation assembly 52. A pilot line 82 communicates the pressure of the hydraulic fluid in the umbilical line 38 to the first valve face 76. The fluid pressure force imparted upon the first valve face 76 by the hydraulic fluid (communicated via the pilot line 82) operates to counteract a fluid pressure force imparted upon the second valve face 78 by the brine in the riser annulus 30 and the force of a spring 80. The spring 80 biases the valve 74 to the open position in the absence of any pressure in the system. The spring, together with riser pressure ($P_{MR}$) acts to deactivate the valve (to its open position) when the control line pressure in 38 is vented. The spring 80 is selected to have a biasing force which is sufficient to compliment the hydrostatic pressure of the brine ($P_{MR}$) and help deactivate the valve 74 as early as practical.

In the event of loss of pressure in the umbilical line 38 occurring, the pressure differential between the brine and the hydraulic fluid increases, with the result that a fluid pressure force imparted upon the second valve face 78 by the brine, together with the force exerted by the spring 80, is greater than the fluid pressure force on the first valve face 76. This shuttles the valve 74 to its open position shown in FIG. 10, opening flow along the conduit 61, through the valve 74 into the conduit 60, and then into the umbilical line 38.

In the main operation state of the pressure compensation assembly 52, the pressure compensator 54 can then act to communicate the external pressure of the brine to the hydraulic fluid in the cylinder 58, raising the pressure of the fluid in the branches 69, 70 and the conduit 61, and communicating this pressure to the hydraulic fluid in the umbilical line 38 through the valve 74 and the conduit 60. In this main operation state, the flow of brine through the first and second valves 66 and 68 of the compensation assembly 52 is prevented, because the pressure differential across the valves is zero (or close to zero), and the valves 66 and 68 are biased to their closed positions.

In the event that the fluid in the pressure compensator cylinder 52 is exhausted, the pressure in the conduits 60, 61, 69 and 70 falls, and the valves 66 and 68 open. Brine then flows into the branch 70 and so through the conduits 61 and 60 into the umbilical line 38, to compensate for the pressure loss. It will be understood that a significant volume of fluid is contained within the marine riser 10, which is more than adequate to compensate for any pressure loss in the umbilical line 38 due to an ongoing leak at surface.

The valve 74 may shuttle back to its closed position of FIG. 9 when the pressure of the hydraulic fluid in the umbilical line 38 has been raised to a safe level. This may occur when the leak at surface has been contained. The valve 74 will shuttle to its closed position once the hydraulic fluid pressure force is sufficient to overcome the combined effect of the combined brine pressure force and the spring 80 force, shunting the valve to its closed position.

Figure 11:
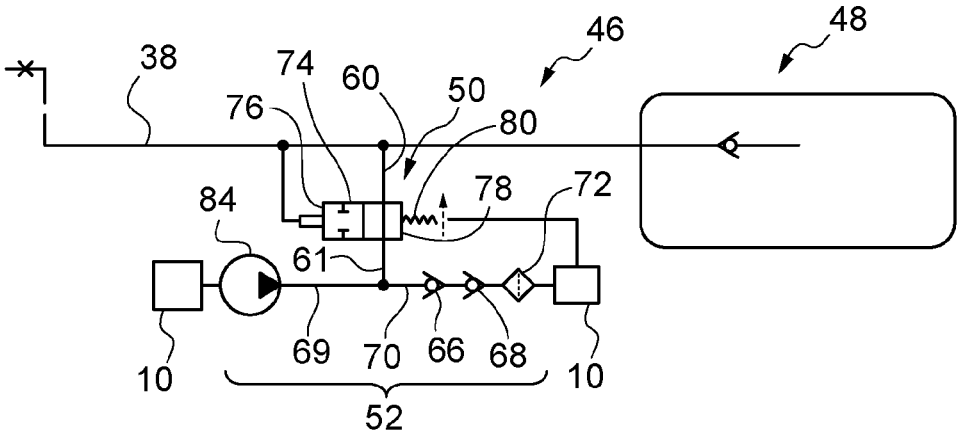
FIG. 11 is a hydraulic circuit diagram showing an umbilical protection system in accordance with another embodiment of the present invention.

Turning now to FIG. 11, there is shown a variation on the umbilical protection system shown in FIGS. 6 to 10 and discussed above. Like components, however, share the same reference numerals.

In this embodiment, a pressure booster or pressure intensifier 84 is provided in place of the pressure compensator 74. The booster 84 is exposed to the brine in the riser annulus 30, and is arranged to direct brine into the umbilical line 38 in the event of a leak occurring at surface. The pressure booster 84 suitably takes the form of a pump, and acts to raise a pressure of the brine that is directed into the umbilical line 38 to a level which is above that of the pressure of the brine in the riser annulus 30. This provides a boost to the pressure of the brine, and so an enhanced compensation effect for the loss of pressure in the line. The pressure booster 84 will typically include a filter (not shown) for filtering contaminants out from the brine. The arrangement of valves 66 and 68 is also maintained, in order to provide a degree of redundancy in the event that the pressure booster 84 should fail to operate as intended. Typically, the pressure compensation assembly 52 will be arranged to have a main operation state in which the valve 74 is opened to communicate the pressure of the hydraulic fluid in the compensation assembly 52 to the marine riser. If required (say in the event of a continued loss of pressure in the umbilical line 38), the booster 84 can be operated to supply brine into the compensation system 52 and so on into the line 38. This may represent a further or second operation state of the system 46. In the event that loss of pressure continues then, in a further (third) operation state the valves 66 and 68 are opened, in a similar way to the pressure compensator 75 and the valves.

Operation of the booster 84 is controlled by a processor (not shown) associated with the valve 74 and the booster. The booster 84 can be arranged so that it operates continuously, but is only effective to vary the pressure of the hydraulic fluid in the line 38 when the valve 74 has been opened. Although the booster 84 has been described as operating prior to the valves 66 and 68, it will be understood that the booster and valves may be arranged in the reverse fashion, so that the valves 66 and 68 are opened prior to the booster 84 being operated.

Figure 11A:
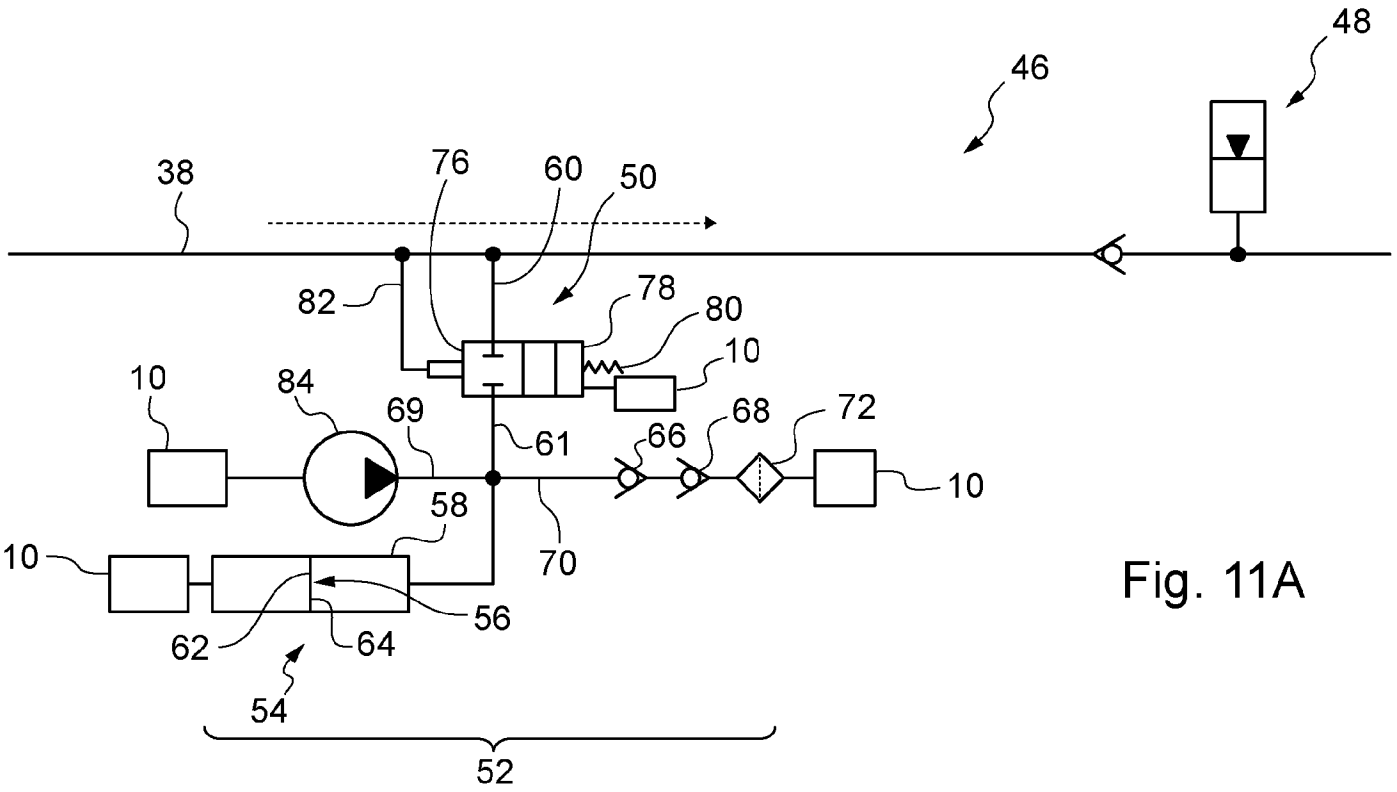
FIG. 11A is a hydraulic circuit diagram showing an umbilical protection system in accordance with a further embodiment of the present invention.

FIG. 11A illustrates a variation on the umbilical protection system 46 shown in FIG. 11, in which the pressure compensator 54 shown in FIGS. 7 to 10 (including the piston 56 moveable within the cylinder 58) is provided in parallel to the booster 84. This may provide a degree of redundancy, and/or may enhance a compensation effect. The booster 84 may be arranged to operate only following exhaustion of the supply of fluid in the compensator cylinder 58; in parallel with and so at the same time as the compensator 54; or prior to operation of the compensator 54, and so with the compensator providing redundancy.

The umbilical protection system of the present invention has been described in relation to the protection of a single umbilical line. It will be understood however that the umbilical 36 will typically comprise two or more hydraulic umbilical lines 38, each associated with a different hydraulically actuated component/equipment, or for operating different parts or functions of a particular component/equipment. The umbilical protection system of the present invention can, however, be used to protect multiple hydraulic umbilical lines, as will now be described in relation to FIG. 12.

Figure 12:
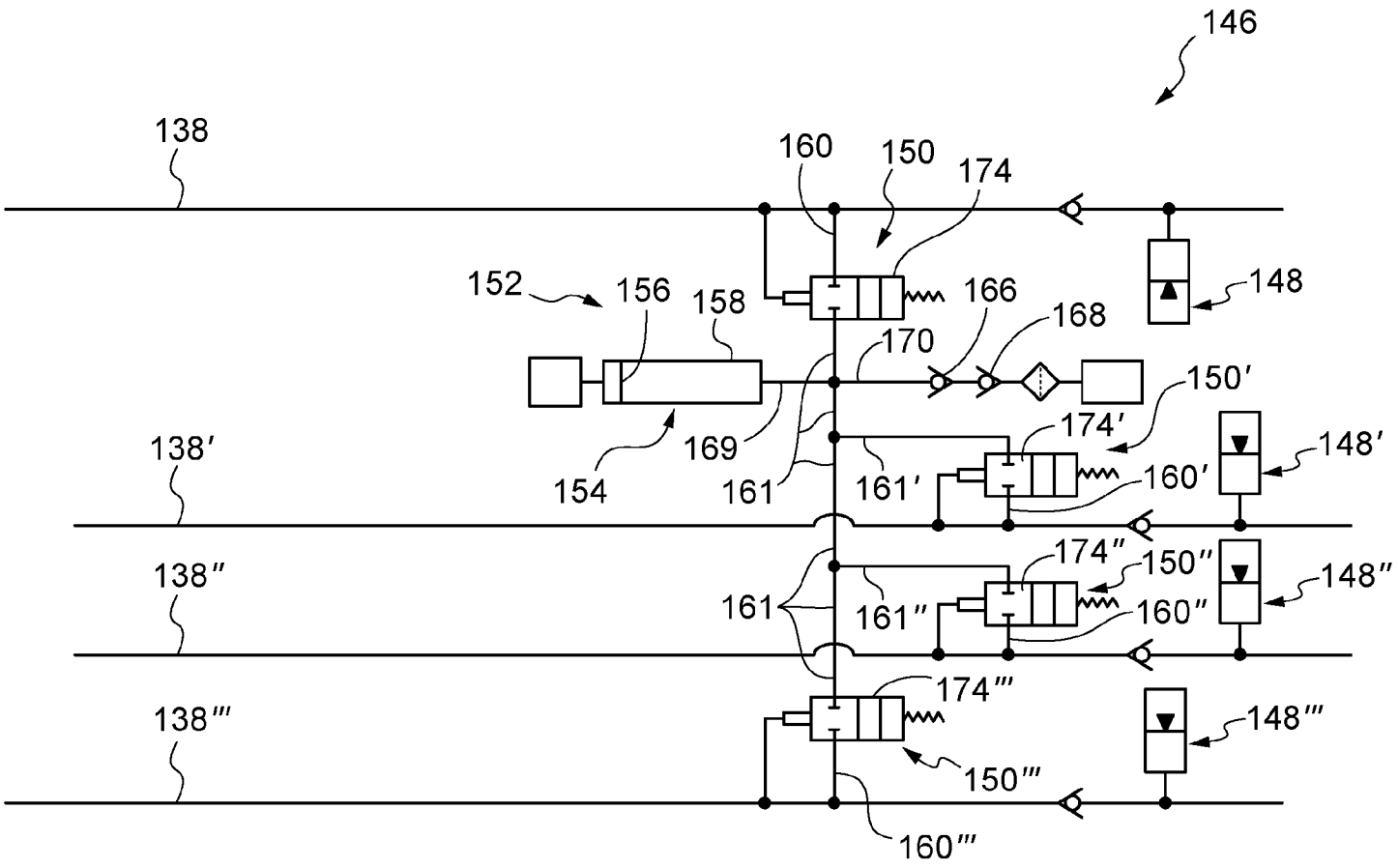
FIG. 12 is a hydraulic circuit diagram showing an umbilical protection system in accordance with a further embodiment of the present invention.

FIG. 12 is a schematic hydraulic circuit diagram of a hydraulic protection system 146. Like components of the protection system 146 with the system 46 of FIGS. 6 to 11 share the same reference numerals, incremented by 100.

In this embodiment, the umbilical comprises four hydraulic umbilical lines 138, 138', 138" and 138'", each of which, in the illustrated embodiment, is a 10 ksi pressure line. The protection system 146 includes a pressure sensing assembly associated with each of the umbilical lines, the pressure sensing assemblies indicated respectively by numerals 150 to 150'". Hydraulically operated components (or different parts of a component/equipment) are associated with each umbilical line and given the numerals 148 to 148'".

The protection system 146 comprises a pressure compensation assembly 152 which is associated with each of the pressure sensing assemblies 150 to 150'". The pressure sensing assembly 152 is of like construction and operation to the assembly 52 shown in FIGS. 8 to 10, and so comprises a pressure compensator 154 including a piston 156 which is moveable within a cylinder 158. It will be understood however that a pressure booster, such as that shown in FIG. 11, may be employed in place of the pressure compensator.

The fluid conduits 160 and 161 connect each of the pressure sensing assemblies 150 to 150'" to the pressure compensation assembly 152 (via branches 161' and 161" in the case of the sensing assemblies 150' and 150"). In the event of a loss of pressure occurring in any one of the umbilical lines 138 to 138'", the pressure compensation assembly 152 is operated to compensate for the pressure loss. This may be achieved by communication of the external pressure of the brine in the riser annulus 30 to the relevant umbilical line 138 to 138'", or the supply of external fluid into the umbilical line, in the fashion described above.

For example, in the event of a loss of pressure occurring in the umbilical line 138", the sensing assembly 150" will detect the pressure loss and will shunt a valve 174" of the sensing assembly to an open position, like that of the sensing assembly 50 shown in FIG. 10. This will serve to open flow along a conduit 160" so that, in a main operation state of the pressure compensation assembly 152, the external pressure of the brine is transmitted to the control fluid in the umbilical line 138" (via the conduits 161 and 161", valve 174" and the conduit 160"). Should the leak continue then, in a further operation state of the compensation assembly 152, valves 166 and 168 will open so that brine is supplied into the conduit 161 via a branch 169, and thus through the conduit 161", valve 174" and conduit 160" into the umbilical line 138".

It will be understood that, in this situation, valves 174, 174' and 174'" of the sensing assemblies 150, 150' and 150'" will remain closed so that there is no communication of external fluid pressure, or indeed actual communication of external fluid, through the conduits 160, 160' and 160'" of the respective sensing assemblies. Equally, in the event that a loss of pressure should occur in two or more of the umbilical lines 138 to 138'", potentially even in all of the umbilical lines, then the relevant sensing assemblies 150 to 150'" will detect the pressure loss, and the compensation assembly 152 will be operated to compensate accordingly. The pressure compensation assembly 152 will be triggered into operation by the first one of the pressure sensing assemblies 150 to 150'" which detects a pressure loss event. In addition, the pressure compensation assembly 152 will remain in its activated state so long as a pressure loss is ongoing in any one of the umbilical lines 138 to 138'".

In the embodiment illustrated in FIG. 12, the pressure compensation assembly 152 of the protection system 146 comprises the pressure compensator 154, including the piston 156 that is moveable within the cylinder 158. It will be understood however that a pressure booster 84 like that shown in FIGS. 11 and 11A may be employed, in place of or in addition to the piston-based pressure compensator 154. In addition, a single pressure compensation assembly is provided that is associated with each one of the umbilical lines 138 to 138'" in the umbilical 36. However, multiple pressure compensation assemblies may be provided, each pressure compensation assembly associated with at least one umbilical line, and optionally with more than one umbilical line.

In a further variation, a hydraulic protection system may be provided which is based on that shown in FIGS. 8 to 11, but without the pressure compensator 54 or booster 84. In this situation, operation of the system may cause the valve 74 to open, enabling marine riser fluid to be supplied into the umbilical line 38, suitably via the valves 66 and 72. This may also apply for one or more of the valves 174, 174' and 174'" of the sensing assemblies 150, 150' and 150'" shown in FIG. 12.

Mention is made herein of a predetermined level of a pressure differential between external fluid (in the riser annulus 30) and control fluid (in the umbilical lines 38). It will be understood that this may vary from one hydraulic system to another, and may be dependent upon a number of factors, including but not restricted to: a collapse pressure rating of the hydraulic line; a density (weight) of the external fluid; a density (weight) of the fluid in the hydraulic line; an expected hydrostatic pressure of the external fluid (e.g. for a particular water depth); and/or an expected hydrostatic pressure of the fluid in the hydraulic line (e.g. for a particular water depth).

The predetermined level may be a negative pressure differential level, when the pressure of the fluid contained within the hydraulic line remains higher than the pressure of the external fluid. This may ensure against hydraulic line collapse by triggering the hydraulic protection system when a leak has occurred, but at a time when the internal hydraulic line pressure is still higher than the external fluid pressure. The predetermined level may be at or around zero pressure differential. Triggering may therefore occur when the pressure of fluid contained within the hydraulic line is the same as (or approximately the same as) the external fluid pressure. The predetermined level may be a positive pressure differential. Triggering may therefore occur when the pressure of fluid contained within the hydraulic line is less than the external fluid pressure, but at a time when the differential is less than the collapse pressure. Factors impacting on the predetermined level (and so triggering of the system) may include depth within a well; hydrostatic pressure; the collapse rating of the hydraulic line; the density of the hydraulic fluid; and the density of the external fluid.

Various modifications may be made to the foregoing without departing from the spirit or scope of the present invention.

For example, it is conceivable that the pressure compensation assembly itself may provide the pressure sensing assembly. For example, in embodiments where a pressure compensation assembly comprising a pressure compensator is provided, a cylinder of the pressure compensator may be in permanent communication with the relevant umbilical line or lines, the piston being movable to compensate for a pressure loss automatically, in the event of a pressure loss within the umbilical line occurring. Flow through valves of the pressure compensation assembly may similarly automatically occur in the event of such a pressure loss.

In a variation, in the piston based pressure compensator, a movable pressure transmission member in the form of a membrane or diaphragm may be provided, which is movable within a chamber in order to communicate external fluid pressure to fluid in the hydraulic line.

Whilst the present invention has been described particularly in relation to an umbilical protection system for protecting an umbilical line of a subsea umbilical (e.g. located within a marine riser), the invention has a use in relation to hydraulic lines used in other environments/industries, and in other applications in the oil and gas exploration and production industry. In general terms, the problems discussed above can be experienced in any situation where a hydraulic line experiences an external pressure differential in which a pressure of fluid external to the line is greater than a pressure of fluid within the line.

In a variation, the pressure compensation assembly may comprise a conduit which is in permanent fluid communication with the external fluid. The pressure sensing assembly may serve for selectively opening fluid communication between the hydraulic line and the conduit in order to transmit external fluid into the line.

The invention claimed is:

1. A hydraulic protection system for preventing collapse of a hydraulic line in the event of a loss of pressure occurring, the system comprising:

a pressure sensing assembly which is arranged, in use, to monitor a pressure differential between fluid external to the hydraulic line and fluid contained within the hydraulic line; and a pressure compensation assembly which is adapted to be coupled to the hydraulic line and which is exposed, in use, to the fluid external to the hydraulic line;

in which, in the event of a loss of pressure in the hydraulic line occurring, the pressure compensation assembly is operable to employ the pressure of the fluid external to the hydraulic line to increase the pressure of the fluid contained within the hydraulic line and thereby compensate for the loss;

in which the system is arranged so that the pressure compensation assembly is operated when the pressure differential monitored by the pressure sensing assembly reaches a predetermined level, which is below a collapse pressure of the hydraulic line, so that exposure of the hydraulic line to the collapse pressure is avoided and collapse of the line prevented;

in which the pressure compensation assembly is arranged so that:

in a main operational state, it can communicate the pressure of the external fluid to the fluid within the hydraulic line; and in a further operational state, it permits fluid communication between the external fluid and the fluid in the hydraulic line.

2. The hydraulic protection system of claim 1, in which the system is an umbilical protection system for protecting an umbilical line of a subsea umbilical from collapsing in the event of a loss of pressure occurring in the umbilical line.

3. The hydraulic protection system of claim 2, in which the umbilical is located within a marine riser, and in which the system is adapted to be disposed within the marine riser and is connectable to the umbilical.

4. The hydraulic protection system of claim 1, in which the pressure sensing assembly is arranged to trigger the pressure compensation assembly when the differential pressure is negative, the pressure of the fluid in the hydraulic line being above that of the external fluid.

5. The hydraulic protection system of claim 1, in which the pressure sensing assembly is arranged to operate the compensation assembly when the pressure differential is approximately zero, the pressure of the fluid in the hydraulic line being approximately equal to that of the external fluid.

6. The hydraulic protection system of claim 1, in which the sensing assembly is arranged to operate the compensation assembly when the pressure differential is positive, the pressure of the fluid in the hydraulic line being below that of the external fluid.

7. The hydraulic protection system of claim 1, in which the pressure sensing assembly is exposed to fluid in the hydraulic line and fluid external to the hydraulic line, the sensing assembly being operable to compare the pressure in the hydraulic line with the external pressure, and to operate the pressure compensation assembly when the differential pressure between the external fluid pressure and the pressure of the fluid in the hydraulic line reaches the predetermined level.

8. The hydraulic protection system of claim 1, in which the pressure compensation assembly is arranged so that it only moves to the further operational state in a situation in which communication of the external pressure to the fluid in the hydraulic line has failed to reduce the pressure differential to a desired level.

9. The hydraulic protection system of claim 1, in which the pressure compensation assembly is coupled to the hydraulic line by a fluid conduit, the fluid conduit containing a hydraulic fluid, so as to provide a fluid barrier between external fluid and the hydraulic fluid in the line.

10. The hydraulic protection system of claim 9, in which the pressure compensation assembly communicates the external fluid pressure to the fluid in the conduit, in a main operational state of the compensation assembly the conduit being out of fluid communication with the external fluid, and in a further operational state of the compensation assembly the conduit being in fluid communication with the external fluid.

11. The hydraulic protection system of claim 1, in which the pressure compensation assembly comprises a pressure compensator which is exposed to the fluid external to the hydraulic line and is in selective communication with the fluid in the hydraulic line, the pressure compensator serving for communicating the pressure of the external fluid to the fluid in the hydraulic line.

12. The hydraulic protection system of claim 1, in which the system is for preventing collapse of a plurality of hydraulic lines, and comprises a plurality of pressure sensing assemblies.

13. The hydraulic protection system of claim 12, in which the pressure compensation assembly is associated with a plurality of the pressure sensing assemblies.

14. The hydraulic protection system of claim 13, in which the pressure compensation assembly is arranged so that it is triggered into operational when a pressure differential measured by any one of the pressure sensing assemblies reaches the predetermined level.

15. A method of preventing collapse of a hydraulic line in the event of a loss of pressure in the hydraulic line occurring, the method comprising the steps of:

monitoring a pressure differential between the fluid external to the hydraulic line and the fluid contained within the hydraulic line;

coupling a pressure compensation assembly to the hydraulic line;

exposing the pressure compensation assembly to the fluid external to the hydraulic line; and in the event of a loss of pressure in the hydraulic line occurring, which loss of pressure leads to an increase in the pressure differential, causing the pressure compensation assembly to employ the pressure of the fluid external to the hydraulic line to increase the pressure of the fluid contained within the hydraulic line and thereby compensate for the loss;

in which the method comprises operating the pressure compensation assembly when the pressure differential monitored by the pressure sensing assembly reaches a predetermined level, which is below a collapse pressure of the hydraulic line, so that exposure of the hydraulic line to the collapse pressure is avoided and collapse of the line prevented; and in which the method comprises the pressure compensation assembly:

in a main operational state, communicating the pressure of the external fluid to the fluid within the hydraulic line; and in a further operational state, permitting fluid communication between the external fluid and the fluid in the hydraulic line.

16. A hydraulic line comprising the hydraulic protection system for preventing collapse of the hydraulic line in the event of a loss of pressure occurring, comprising:

a pressure sensing assembly which is arranged, in use, to monitor a pressure differential between fluid external to the hydraulic line and fluid contained within the hydraulic line; and a pressure compensation assembly which is adapted to be coupled to the hydraulic line and which is exposed, in use, to the fluid external to the hydraulic line;

in which, in the event of a loss of pressure in the hydraulic line occurring, the pressure compensation assembly is operable to employ the pressure of the fluid external to the hydraulic line to increase the pressure of the fluid contained within the hydraulic line and thereby compensate for the loss;

in which the system is arranged so that the pressure compensation assembly is operated when the pressure differential monitored by the pressure sensing assembly reaches a predetermined level, which is below a collapse pressure of the hydraulic line, so that exposure of the hydraulic line to the collapse pressure is avoided and collapse of the line prevented;

in which the pressure compensation assembly is arranged so that:

in a main operational state, it can communicate the pressure of the external fluid to the fluid within the hydraulic line; and in a further operational state, it permits fluid communication between the external fluid and the fluid in the hydraulic line.

17. The subsea umbilical/subsea riser/hydraulic line of claim 16, in which the pressure sensing assembly is arranged to operate the compensation assembly when the pressure differential is approximately zero, the pressure of the fluid in the hydraulic line being approximately equal to that of the external fluid.

18. The subsea umbilical/subsea riser/hydraulic line of claim 16, in which the sensing assembly is arranged to operate the compensation assembly when the pressure differential is positive, the pressure of the fluid in the hydraulic line being below that of the external fluid.

19. The subsea umbilical/subsea riser/hydraulic line of claim 16, in which the pressure sensing assembly is exposed to fluid in the hydraulic line and fluid external to the hydraulic line, the sensing assembly being operable to compare the pressure in the hydraulic line with the external pressure, and to operate the pressure compensation assembly when the differential pressure between the external fluid pressure and the pressure of the fluid in the hydraulic line reaches the predetermined level.

20. The subsea umbilical/subsea riser/hydraulic line of claim 16, in which the pressure compensation assembly is arranged so that it only moves to the further operational state in a situation in which communication of the external pressure to the fluid in the hydraulic line has failed to reduce the pressure differential to a desired level.

* * * * *